US011359337B2

(12) United States Patent
Zhang

(10) Patent No.: US 11,359,337 B2
(45) Date of Patent: Jun. 14, 2022

(54) COMPOSITE ROAD MODULE, UNIT AND SYSTEM

(71) Applicant: DU KUAI TONG (BEIJING) TRAFFIC DISPERSION EQUIPMENT CO., LTD., Beijing (CN)

(72) Inventor: Huidong Zhang, Beijing (CN)

(73) Assignee: DU KUAI TONG (BEIJING) TRAFFIC DISPERSION EQUIPMENT CO., LTD., Beijing (CN)

( * ) Notice: Subject to any disclaimer, the term of this patent is extended or adjusted under 35 U.S.C. 154(b) by 319 days.

(21) Appl. No.: 16/626,120

(22) PCT Filed: Feb. 11, 2018

(86) PCT No.: PCT/CN2018/076245
§ 371 (c)(1),
(2) Date: Mar. 20, 2020

(87) PCT Pub. No.: WO2019/007070
PCT Pub. Date: Jan. 10, 2019

(65) Prior Publication Data

US 2020/0224370 A1 Jul. 16, 2020

(30) Foreign Application Priority Data

Jul. 1, 2017 (CN) ..... 201710527697.1

(51) Int. Cl.
*E01C 1/00* (2006.01)

(52) U.S. Cl.
CPC ..... *E01C 1/002* (2013.01)

(58) Field of Classification Search
CPC ..... E01C 1/002; E01C 1/04
(Continued)

(56) References Cited

U.S. PATENT DOCUMENTS 3,915,580 A * 10/1975 Kaufman ..... E01C 1/02 404/1
4,955,751 A * 9/1990 Tsai ..... E01C 1/04 404/1

(Continued)

FOREIGN PATENT DOCUMENTS

CN 1542225 A 11/2004
CN 101538820 A 9/2009

(Continued)

OTHER PUBLICATIONS

PCT, "International Preliminary Report on Patentability in App. No. PCT/CN2018/076245" dated Jan. 7, 2020.

(Continued)

*Primary Examiner* — Raymond W Addie
(74) *Attorney, Agent, or Firm* — Dorsey & Whitney LLP

(57) ABSTRACT

A present invention relates to a composite road module, unit and system. The composite road module comprising a first road and a second road extending substantially in parallel, one of the first road and the second road being configured for vehicles to travel according to a left-hand traffic rule, the other being configured for vehicles to travel according to a right-hand traffic rule, the first road comprising a first lane and a second lane, the second road comprising a third lane and a fourth lane, wherein the first lane and the third lane are in communication with each other, and are provided for vehicles to travel in a first direction, and wherein the second lane and the fourth lane are in communication with each other, and are provided for vehicles to travel in a second direction opposite to the first direction.

16 Claims, 30 Drawing Sheets

(a)

(b)

(58) Field of Classification Search
USPC ..... 404/1
See application file for complete search history.

(56) References Cited

U.S. PATENT DOCUMENTS

| | | | | |
|---|---|---|---|---|
| 5,846,020 | A * | 12/1998 | McKeown | E01C 1/002 404/1 |
| 5,921,701 | A | 7/1999 | Clayton | |
| 7,857,543 | B2 * | 12/2010 | Troster | E01C 1/002 404/1 |
| 8,172,478 | B2 * | 5/2012 | Sing | E01C 1/002 404/1 |
| 9,441,331 | B2 * | 9/2016 | Chen | E04H 6/08 |
| 2009/0052983 | A1 * | 2/2009 | Goj | E01C 1/04 404/1 |
| 2009/0125160 | A1 * | 5/2009 | Desai | B62D 61/08 701/1 |

FOREIGN PATENT DOCUMENTS

| | | | |
|---|---|---|---|
| CN | 101581064 | A | 11/2009 |
| GB | 2466279 | A | 6/2010 |
| RU | 2152471 | C1 | 7/2000 |

OTHER PUBLICATIONS

PCT, "International Search Report and Written Opinion in App. No. PCT/CN2018/076245", dated May 22, 2018.

* cited by examiner

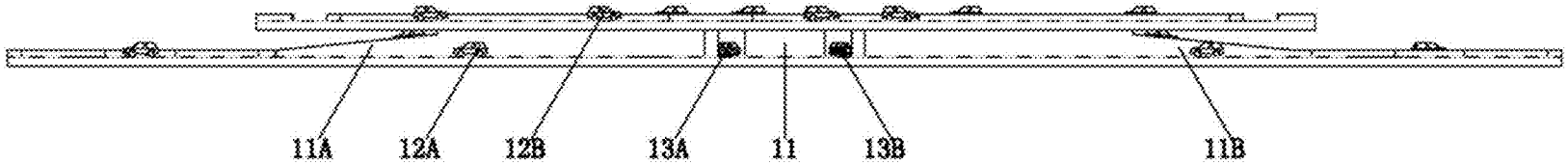
(a)
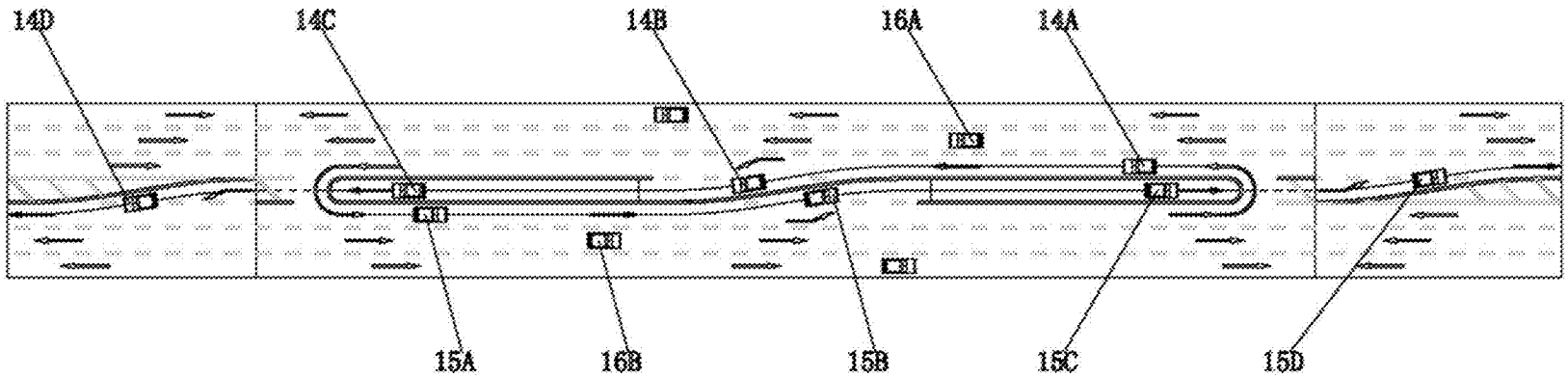
(b)
FIG. 3

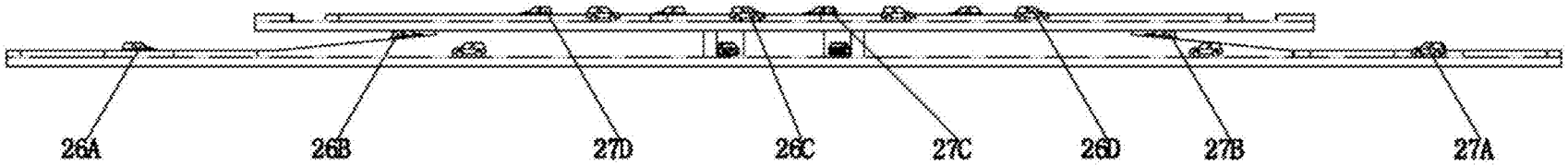
(a)
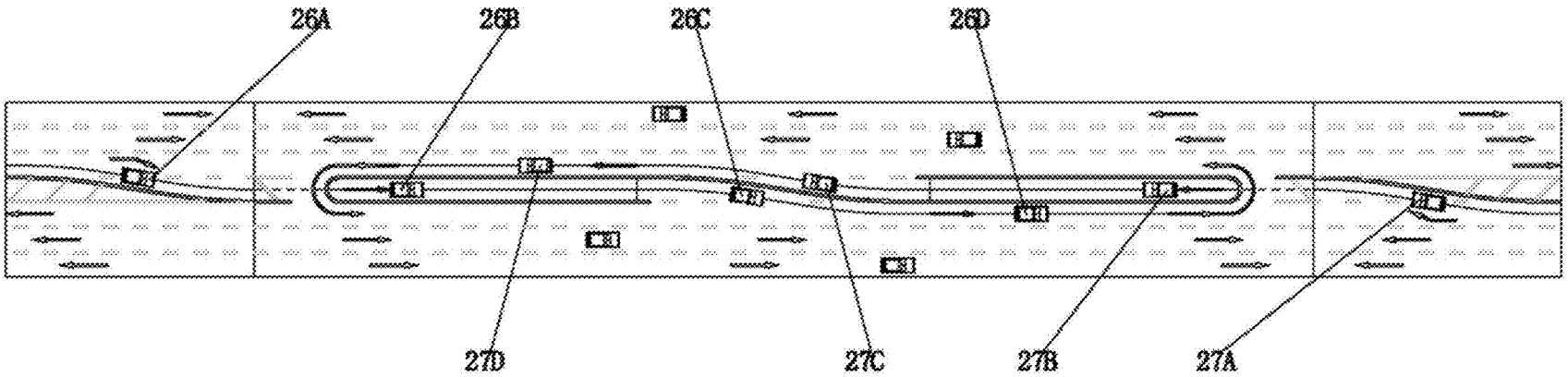
(b)
FIG. 7

29D
29C
29C
29D
29D
29B
29A
28A
CN0000
CN0000
CN0000

COMPOSITE ROAD MODULE, UNIT AND SYSTEM

FIELD OF THE INVENTION

The present invention generally relates to a composite road module. The present invention also relates to a composite road unit and a composite road system comprising the composite road module.

BACKGROUND OF THE INVENTION

In terms of traffic rules, in some countries, such as China, United States of America, Canada and most European countries, vehicles are driven on roads according to right-hand traffic rule, while in other countries, such as the United Kingdom, Japan, India, vehicles are driven on roads according to left-hand traffic rule. However, in a same country or region, a same road section is generally allowed to travel only according to one rule, either on the left or on the right, and both are generally not allowed.

Urban traffic congestion just originates from "left and right mixed traffic": at a planar intersection, vehicles going straight and vehicles turning left and right need to be directed by signal lamps, to wait in line and pass through the intersection in turn. This results in long waiting time of vehicles and inefficient traffic. Planar intersections, like individual "bottlenecks" placed on urban roads, can severely reduce the throughput of urban roads. In addition, a number of vehicles in modern cities increase year by year, such that the congestion problem becomes more and more prominent and becomes a great social problem.

The conflict at the planar intersection can be better solved by building an interchange (or called "flyover" or "overpass"), and all conflict points can be eliminated by complete functional interchange-typed interchanges. However, such an interchange is huge in size and occupies an extremely large area, and thus cannot be applied to urban areas with cramped terrain.

Interchanges or overpasses are built only at a small part of important intersections, while other planar intersections are still maintained. However, the maintained planar intersections form "short plates of a wooden barrel", and the problems cannot be entirely solved by the few interchanges. Also, it is impossible to build a fully functional interchange at each intersection. Therefore, the problem of urban traffic congestion becomes a troublesome world problem.

SUMMARY OF THE INVENTION

The invention mainly aims to fundamentally solve the persistent problem of urban traffic congestion, and the main idea of the invention is to provide a road driving solution of "left and right split driving". Here, the following definitions about "left type" and "right type" need to be made. Taking the most common crossroad as an example, vehicles drive from four directions: north, west, south, and east. When a vehicle from each direction arrives at the intersection, there are three choices: straight run, left turn or right turn. Each choice will form one traffic flow, and there are twelve traffic flows in four directions. These traffic flows will form a lot of traffic conflict points.

What is needed to do in the "left and right split driving" solution is to divide the twelve traffic flows into two types, namely left type and right type. Four left turns are "natural left", two opposite straight runs, e.g., north to south and south to north, are designated as "defined left"; accordingly, four right turns are "natural right" and the remaining east to west and west to east straight runs are "defined right". According to the above classification method, twelve oncoming traffic flows at the crossroad are classified into six types of "left-typed vehicles" and six types of "right-typed vehicles".

The invention provides a composite road module which comprises a first road and a second road, wherein one of the first and second roads is a left-typed road, the other is a right-typed road, and vehicles follow the left-hand traffic rule in the left-typed road, and follow the right-hand traffic rule in the right-typed road. The "left and right split driving" traffic mode is implemented such that the left-typed vehicles enter the left-typed road and the right-typed vehicles enter the right-typed road. Therefore, conflict points can be completely eliminated, vehicles can respectively run on the own roads and can smoothly pass through intersections, and traffic lights will no longer be needed in urban road networks.

The composite road module of the invention is particularly a double-layered road module (or called "a double-deck road module"), wherein the first and second roads are respectively formed as upper and lower-layered roads; correspondingly, the crossroads are also all divided into upper level intersections and lower level intersections; the twelve traffic flows at the crossroads drive according to the "left and right split driving" solution such that six traffic flows drive on the upper level, and the other six roads drive on the lower level, that is, the traffic flows are evenly distributed.

Alternatively, the inventive composite road module may also be a planar road module, wherein the first and second roads are located substantially on a same horizontal plane.

Of course, the "left type" or "right type" of a vehicle is mentioned relative to the intersection ahead. For example, a vehicle is "left-typed" at this intersection, and may be "right-typed" at the next intersection. Therefore, whether a vehicle is suitable for running on the first road or the second road is determined according to whether the vehicle is to run straight, turn left, or turn right at the intersection ahead. In view of this property, the first and second roads need to have a powerful "intercommunication" function, so that the vehicles can arbitrarily change their types (left type and right type) at any time, so as to pass through each intersection quickly and efficiently.

The so-called "intercommunication" function is actually implemented by means of a set of connecting passages. In order to realize the complete function of intercommunication, four connecting passages with two entering passages and two exiting passages are needed, to ensure that vehicles on two sides of the first road can be driven onto the second road, and vehicles on two sides of the second road can be also driven onto the first road. In the case of a double-layered road, the connecting passages are ramps which communicate the roads of different heights. In the case of a planar road, the above-mentioned connecting passages are bypasses, archways or bends which communicate the roads of the same height.

In summary, a "left and right split driving composite road module" with a complete function is a composite road segment which has two roads for vehicles travelling according to different traffic rules, and which has connecting passages and respective exits and entrances, the connecting passages being located between two adjacent intersections and meeting a complete intercommunication function. At the same time, a composite road module and its intersection(s) at one or both ends form a basic composite road unit. In addition, one or more composite road units, one or more composite road modules, and/or one or more existing roads together form a composite road system. In addition, the composite road module of the present invention may also have more than two exits and/or more than two entrances.

In one aspect, the present invention provides a composite road module comprising a first road and a second road extending substantially in parallel, one of the first road and the second road being configured for vehicles to travel according to a left-hand traffic rule, the other of the first road and the second road being configured for vehicles to travel according to a right-hand traffic rule, the first road comprising a first lane and a second lane, the second road comprising a third lane and a fourth lane, wherein the first lane and the third lane are in communication with each other, and are provided for vehicles to travel in a first direction, and wherein the second lane and the fourth lane are in communication with each other, and are provided for vehicles to travel in a second direction opposite to the first direction.

In a preferred embodiment, the first lane and the second lane are arranged side by side to form an upper-layered road, and the third lane and the fourth lane are arranged side by side to form a lower-layered road, wherein the third lane and the fourth lane are located below the second lane and the first lane, respectively.

Preferably, the composite road module further comprises: a first connecting passage that communicates the first lane to the third lane; a second connecting passage that communicates the second lane to the fourth lane; a third connecting passage that communicates the third lane to the first lane; and a fourth connecting passage that communicates the fourth lane to the second lane. Advantageously, one end of each of the first, second, third and fourth connecting passages is located between the first lane and the second lane, and the other end is located between the third lane and the fourth lane. Advantageously, the upper-layered road comprises a first separator and a second separator between the first lane and the second lane, and the lower-layered road comprises a third separator between the third lane and the fourth lane.

In one variant, the first, second, fourth and third connecting passages are arranged sequentially in a longitudinal direction. Advantageously, said one end of said first connecting passage and said one end of said second connecting passage are laterally located on both sides of said first separator, said one end of said third connecting passage and said one end of said fourth connecting passage are laterally located on both sides of said second separator, and said other end of said second connecting passage and said other end of said fourth connecting passage are laterally located on a same side of said third separator.

Preferably, the composite road module further comprises two sloping benches located between the upper-layered road and the lower-layered road, one of the two sloping benches being formed by the first connecting passage and the second connecting passage, and the other being formed by the fourth connecting passage and the third connecting passage.

Preferably, the third separator comprises a partition pillar at a side facing the fourth lane so as to longitudinally separate the other end of the second connecting passage from the other end of the fourth connecting passage.

In another variant, the third, first, fourth and second connecting passages are arranged sequentially in the longitudinal direction. Advantageously, said one end of said third connecting passage and said one end of said first connecting passage are laterally on a same side of said first separator, said one end of said fourth connecting passage and said one end of said second connecting passage are laterally on the same side of said second separator, and said other end of said first connecting passage and said other end of said fourth connecting passage are laterally on both sides of said third separator.

Preferably, the composite road module further comprises two sloping benches located between the upper-layered road and the lower-layered road, one of the two sloping benches being formed by the third connecting passage and the first connecting passage, and the other being formed by the fourth connecting passage and the second connecting passage.

Preferably, the first separator comprises a partition pillar at a side facing the first lane so as to longitudinally separate the one end of the third connecting passage from the one end of the first connecting passage. Advantageously, the second separator comprises a partition pillar at a side facing the second lane so as to longitudinally separate the one end of the fourth connecting passage from the one end of the second connecting passage.

Preferably, each sloping bench has a substantially trapezoidal longitudinal section, and preferably, each sloping bench comprises two U-turn passages for communicating the third lane with the fourth lane.

Preferably, the upper-layered road further comprises a fourth separator between the first lane and the second lane, the fourth separator being located between the first separator and the second separator, and spaced apart from the first separator and the second separator so as to allow the first lane and the second lane to communicate with each other.

Preferably, one or more of the first separator, the second separator, the third separator and the fourth separator are provided with no-entry zones or parking zones on both sides.

Preferably, the lower-layered road is flush with the ground, and the upper-layered road is elevated above the lower-layered road. Preferably, the lower layer road is wider than the upper-layered road.

Alternatively, the upper-layered road is flush with the ground, and the lower-layered road is sunk below the upper-layered road.

In another preferred embodiment, the second lane, the third lane, the fourth lane and the first lane are arranged sequentially side by side in a transverse direction.

Preferably, the composite road module further comprises a first, a second, a third and a fourth connecting passages, and the second road further comprises a first road segment and a second road segment, wherein the first connecting passage bypasses one port of the first road segment to communicate the first lane to the third lane, the second connecting passage bypasses one port of the second road segment to communicate the second lane to the fourth lane, the third connecting passage bypasses another port of the first road segment to communicate the third lane to the first lane, and the fourth connecting passage bypasses another port of the second road segment to communicate the fourth lane to the second lane. Preferably, the first road segment and the second road segment are sunk below the third lane and the fourth lane or are elevated above the third lane and the fourth lane.

Alternatively, the composite road module further comprises: a first archway that bridges the fourth lane to communicate the first lane to the third lane; a second archway that bridges the third lane to communicate the second lane to the fourth lane; a third archway that bridges the fourth lane to communicate the third lane to the first lane; and a fourth archway that bridges the third lane to communicate the fourth lane to the second lane.

Alternatively, each of the passages in the composite road module communicates with each of the other three passages in another composite road module via bends.

Advantageously, the bends are located in the intersection.

In another aspect, the present invention provides a composite road unit comprising: a composite road module according to the present invention; and one or two road junctions for a plurality of road directions, each road junction comprising a primary intersection and a secondary intersection, wherein the primary intersection comprises a primary central portion and a plurality of pairs of primary passages extending outwardly from the primary central portion in the plurality of road directions, respectively, each pair of primary passages comprising a primary ascending passage and a primary descending passage arranged side by side, wherein the secondary intersection is independent of the primary intersection, and comprises a secondary central portion and a plurality of pairs of secondary passages extending outwardly from the secondary central portion in the plurality of road directions, respectively, each pair of secondary passages comprising a secondary ascending passage and a secondary descending passage arranged side by side, wherein the primary ascending passage in each pair of primary passages communicates, via the primary central portion, with the primary descending passage of an adjacent pair of primary passages in one of a clockwise direction and a counter-clockwise direction, and the secondary ascending passage in each pair of secondary passages communicates, via the secondary central portion, with the secondary descending passage of an adjacent pair of secondary passages in the other of the clockwise direction and the counter-clockwise direction, and wherein a primary ascending passage and a primary descending passage of a pair of primary passages of the plurality of pairs of primary passages communicate with the first lane and the second lane, respectively, and a secondary ascending passage and a secondary descending passage of a corresponding pair of secondary passages of the plurality of pairs of secondary passages communicate with the third lane and the fourth lane, respectively.

Preferably, a primary ascending passage and a primary descending passage in a first pair of primary passages communicate with a primary descending passage and a primary ascending passage in a third pair of primary passages, respectively, via the primary central portion, and a second pair of primary passages is not in communication with a fourth pair of primary passages. Advantageously, a secondary ascending passage and a secondary descending passage of a second pair of secondary passages communicate with a secondary descending passage and a secondary ascending passage of a fourth pair of secondary passages, respectively, via the secondary central portion, and a first pair of secondary passages is not in communication with a third pair of secondary passages.

Alternatively, the primary ascending passage and the primary descending passage of the first pair of primary passages communicate with the primary descending passage and the primary ascending passage of the third pair of primary passages, respectively, via the primary central portion, and the primary ascending passage and the primary descending passage of the second pair of primary passages communicate with the primary descending passage and the primary ascending passage of the fourth pair of primary passages, respectively, via the primary central portion. Advantageously, the first pair of secondary passages is not in communication with the third pair of secondary passages, and the second pair of secondary passages is not in communication with the fourth pair of secondary passages.

Preferably, the secondary intersection is in the same plane as the primary intersection, and each pair of primary passages is located on either side of a respective pair of secondary passages. Advantageously, the primary ascending passage in each road direction communicates with the secondary descending passages in the other three road directions via said primary central portion, and the secondary ascending passage in each road direction communicates with the primary descending passages in the other three road directions via said primary central portion.

In a further aspect, the present invention provides a composite road system comprising one or more composite road units according to the present invention and/or one or more composite road modules according to the present invention. Preferably, the composite road system further comprises one or more existing roads.

Preferably, the composite road system comprises a plurality of composite road modules including at least one first composite road module arranged in a double-layered form and at least one second composite road module arranged in a planar form, wherein a first road and a second road of the second composite road module are connected to a first road and a second road of the first composite road module, respectively.

There are two main aspects in terms of economic benefits of the present invention:

First, the conflict points at the intersections will be completely eliminated. The contradiction conflicts of urban road intersections are the most main factor causing traffic jam. Taking China as an example, in a traffic system according to the right-hand traffic rule, turning left brings many conflict points. If the left and right split driving composite road unit can be applied onto all main roads, namely, a completely functional interchange is established at each intersection, it is very effective for solving congestion trouble.

Second, the phenomenon of indirect left turn with U-turn can be entirely eliminated. In order to ensure driving safety, roads in modern cities are often divided into two by using isolation facilities such as separators, green isolation belts, etc. For secondary roads beside the main roads and leading to urban functional zones, their intersections with the main roads form a series of T-shaped intersections. Taking Chinese right-hand traffic system as an example, vehicles cannot turn left directly, but need indirectly turn left by firstly turning right and then making a U-turn at an intersection ahead. Such a mode of indirect left turn with U-turn causes waste of time and procedures. After the left and right split driving composite road unit is introduced, vehicles can directly turn left to enter and exit the main road, such that efficiency is greatly improved, time is saved, oil consumption is reduced, thereby bringing great economic benefits.

The present invention has more remarkable social benefits: it can profoundly change the pattern of existing urban roads and promote early realization of future comprehensive autonomous driving goal. It is of great significance for the construction of smart cities and the promotion of social harmony.

BRIEF DESCRIPTION OF DRAWINGS

FIGS. 2 to 5 are schematic views of entrance areas of the double-layered road unit according to the present invention;

FIGS. 6 to 9 are schematic views of exit areas of the double-layered road unit according to the present invention;

DETAILED DESCRIPTION OF PREFERRED EMBODIMENTS

Figure 1:
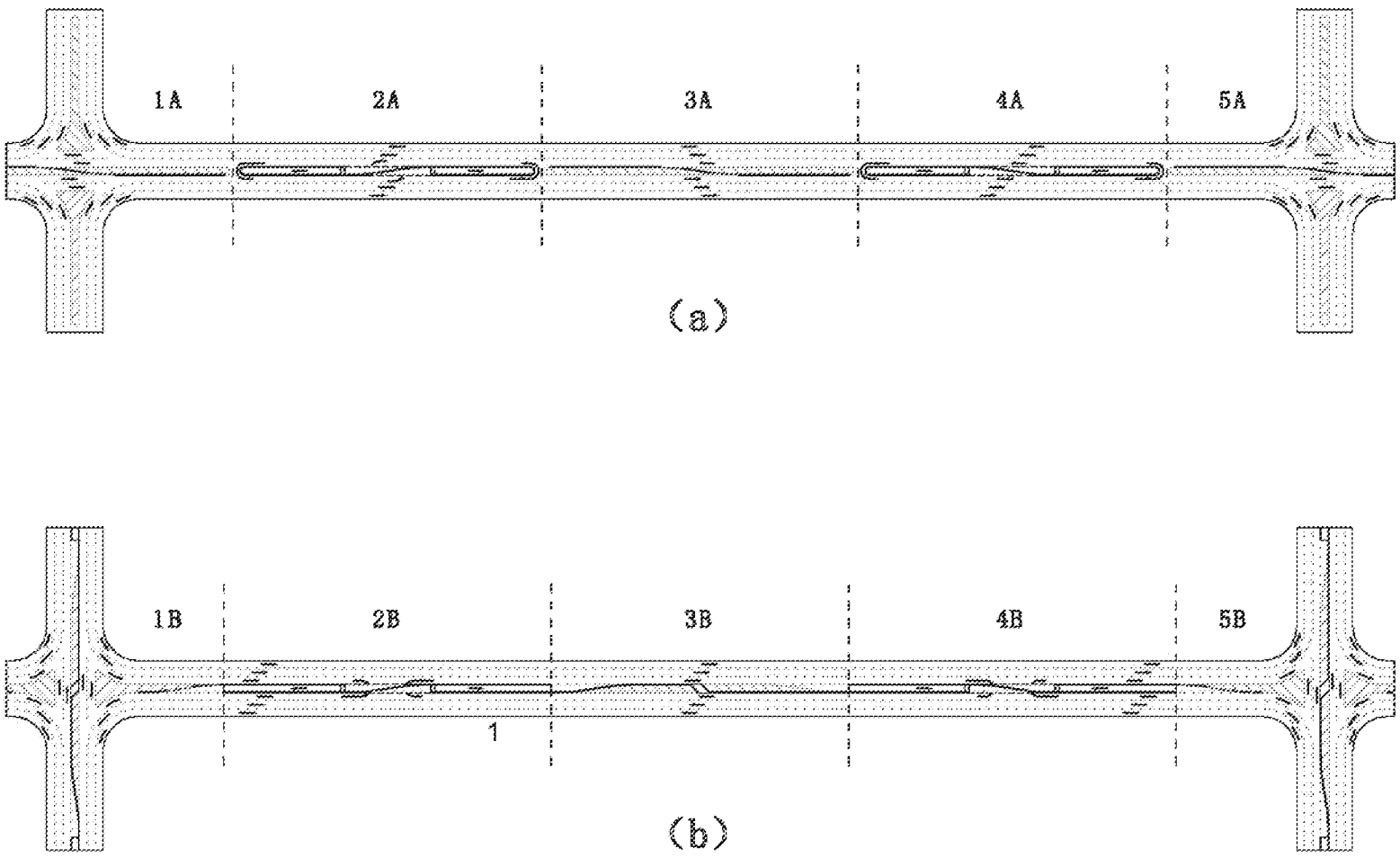
FIG. 1 schematically illustrates one embodiment of a composite road unit according to the present invention, the composite road unit being a double-layered road unit.

To facilitate understanding the present invention, the invention will now be described more fully with reference to the accompanying drawings. Preferred embodiments of the present invention are shown in the drawings. This invention may, however, be embodied in many different forms and should not be construed as limited to the embodiments set forth herein. Rather, these embodiments are provided for fully and completely understanding the disclosure of the present invention.

The term "ascending" or "descending" does not refer to "up" or "down" in height, but rather means entering or leaving an intersection. Likewise, "ascending passage" or "descending passage" refers to a passage via which a vehicle enters or leaves an intersection, regardless of change in height as the vehicle enters or leaves.

The term "connect" (or "connected" or "connection") or "communicate" (or "communicated" or "communication") means that a vehicle traveling on one lane can be transferred onto another lane.

The term "longitudinal" or "longitudinally" refers to a direction in which a road extends, and the term "lateral", "laterally", "transverse" or "transversely" refers to a direction across a road.

Various embodiments according to the present invention will be described in detail below with reference to the accompanying drawings.

FIG. 1 shows a typical left and right split driving double-layered road unit, having a double-layered structure including two adjacent intersections and roads therebetween, wherein figure (a) shows an upper-layered road and figure (b) shows a lower-layered road. The driving directions of the upper-layered road and the lower-layered road are opposite, one according to the right-hand traffic rule, the other according to the left-hand traffic rule.

A basic road unit can be divided into five parts, namely left-side intersections 1A and 1B, entrance areas 2A and 2B, separation areas 3A and 3B, exit areas 4A and 4B and right-side intersections 5A and 5B.

The structure and use of the basic road unit will be described in the following in terms of four parts, i.e., the entrance areas, the exit areas, the separation areas, and the intersections.

Figure 2:
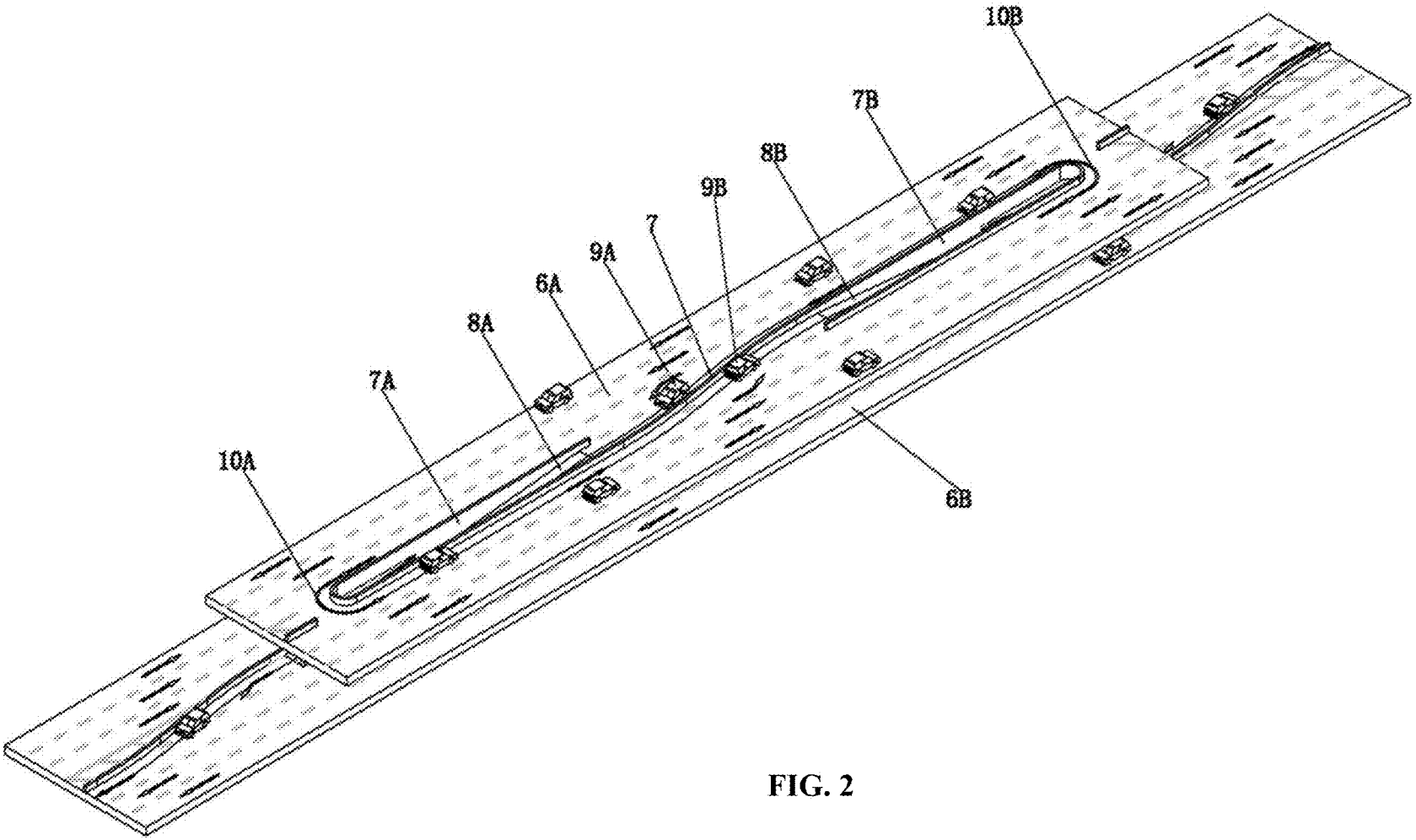

FIG. 2 shows a schematic view of the entrance areas. Vehicles on the upper-layered road 6A travel according to the right-hand traffic rule, and vehicles on the lower-layered road 6B travel according to the left-hand traffic rule. This is a "two-in-one" composite entrance comprising two entrances 8A and 8B. The two entrances are separated by a separator 7 which is integrated with a fence 7A of the left entrance 8A and a fence 7B of the right entrance 8B. Openings of the two entrances 8A and 8B are opposite to each other. Vehicles 9A and 9B, which are preparing to drive from the upper layer to the lower layer, turn left and adjust their heads to enter the respective entrances 8A and 8B. Vehicle U-turn areas 10A and 10B are provided at round ends of the side fences 7A and 7B, respectively.

FIGS. 3(*a*) and (*b*) show a side view and a top view of the entrance areas in FIG. 2, respectively. It can be seen in the figure (a) that a lower vehicle 12A on the outer side heads to the left, while the upper vehicle 12B heads to the right, with the traveling directions of the two vehicles being opposite to each other. A trapezoidal sloping bench 11 communicating the upper lower-layered road with the lower-layered road is a double-sided sloping bench, and the left inclined surface 11A and the right inclined surface 11B act as downward passages for vehicles. Two through U-turn passages, where turning vehicles 13A and 13B on the lower-layered road make U-turn, are arranged at the middle lower part of the trapezoidal sloping bench. The process of the upper vehicle passing to the lower-layered road can be seen in figure (b). A vehicle running on the left side of the upper-layered road still keeps going straight at a position 14A, starts turning left to prepare for entering the entrance at a position 14B, then enters a position 14C of a ramp and continues to run downwards, and after reaching a position 14D of the lower-layered road, turns left to enter the right side of the lower-layered road. Similarly, a vehicle traveling on the right side of the upper-layered road enters the left side of the lower-layered road through several key location points 15A, 15B, 15C, and 15D. Vehicles 16A and 16B passing beside the entrances without intercommunication continue to go straight in their respective directions.

Figure 4:
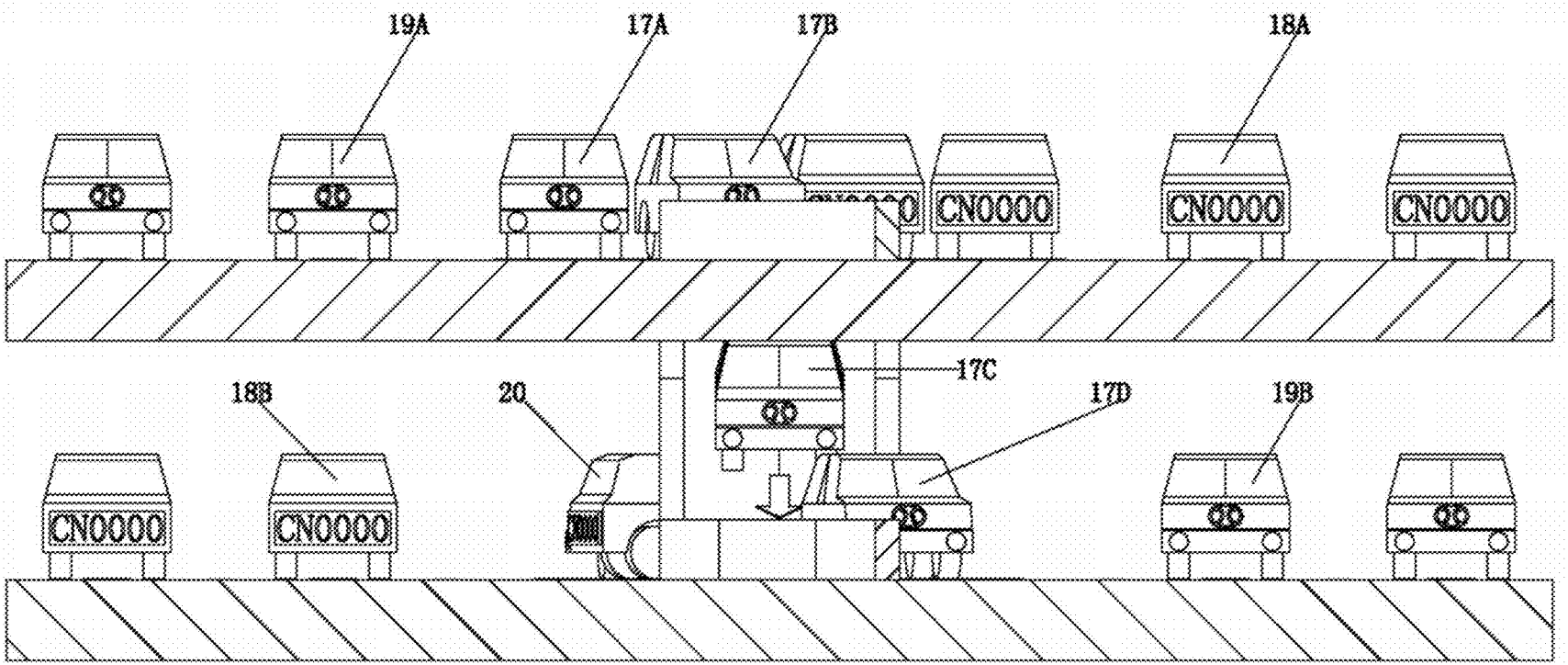

FIG. 4 shows a cross-sectional view of the entrance area of FIG. 2, in which the characteristics of the upper and lower-layered roads in opposite directions can be more clearly seen. A vehicle 18A on the right side of the upper-layered road and a vehicle 18B on the left side of the lower-layered road are shown with their rear portions facing outward. A vehicle 19A on the left side of the upper-layered road and a vehicle 19B on the right side of the lower-layered road are shown with their heads facing outwards. This "diagonal co-directional" feature makes it possible to "diagonally intercommunicate". A vehicle from the left side of the upper-layered road can smoothly enter the "diagonal" lower-layered right side road after passing through the four key positions 17A, 17B, 17C and 17D. A turning vehicle 20 on the left side of the lower-layered road is entering the lower-layered right side road from the U-turn passage.

Figure 5:
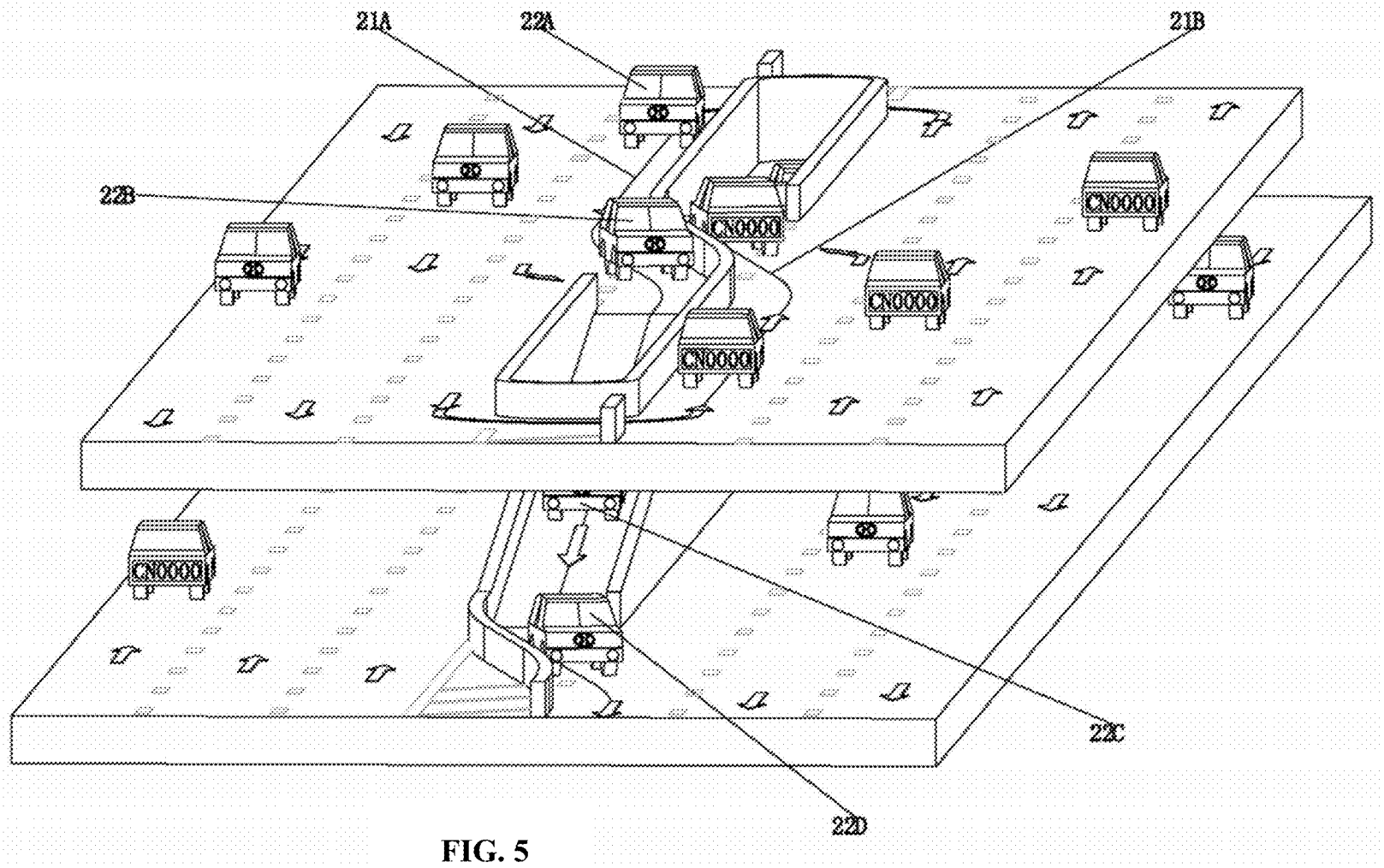

FIG. 5 shows another perspective view of the entrance area of FIG. 2 in which up and down intercommunicating driving trajectories of vehicles can be relatively completely seen. In the figure, 21A indicates a downward trajectory along which a travelling vehicle remains straight at position 22A, turns left at position 22B, passes through position 22C in a downward ramp, reaches the lower-layered road at position 22D, and turns left once again. In addition to two straight lines on the upper-layered road and lower-layered road, the trajectory 21A has two lane changing curves and one downward ramp line. Similarly, the same is true of the other trajectory 21B. Vehicles follow the trajectories 21A and 21B to complete the intercommunication from the upper-layered road to the lower-layered road by two left turns and one downward ramp.

Figure 6:
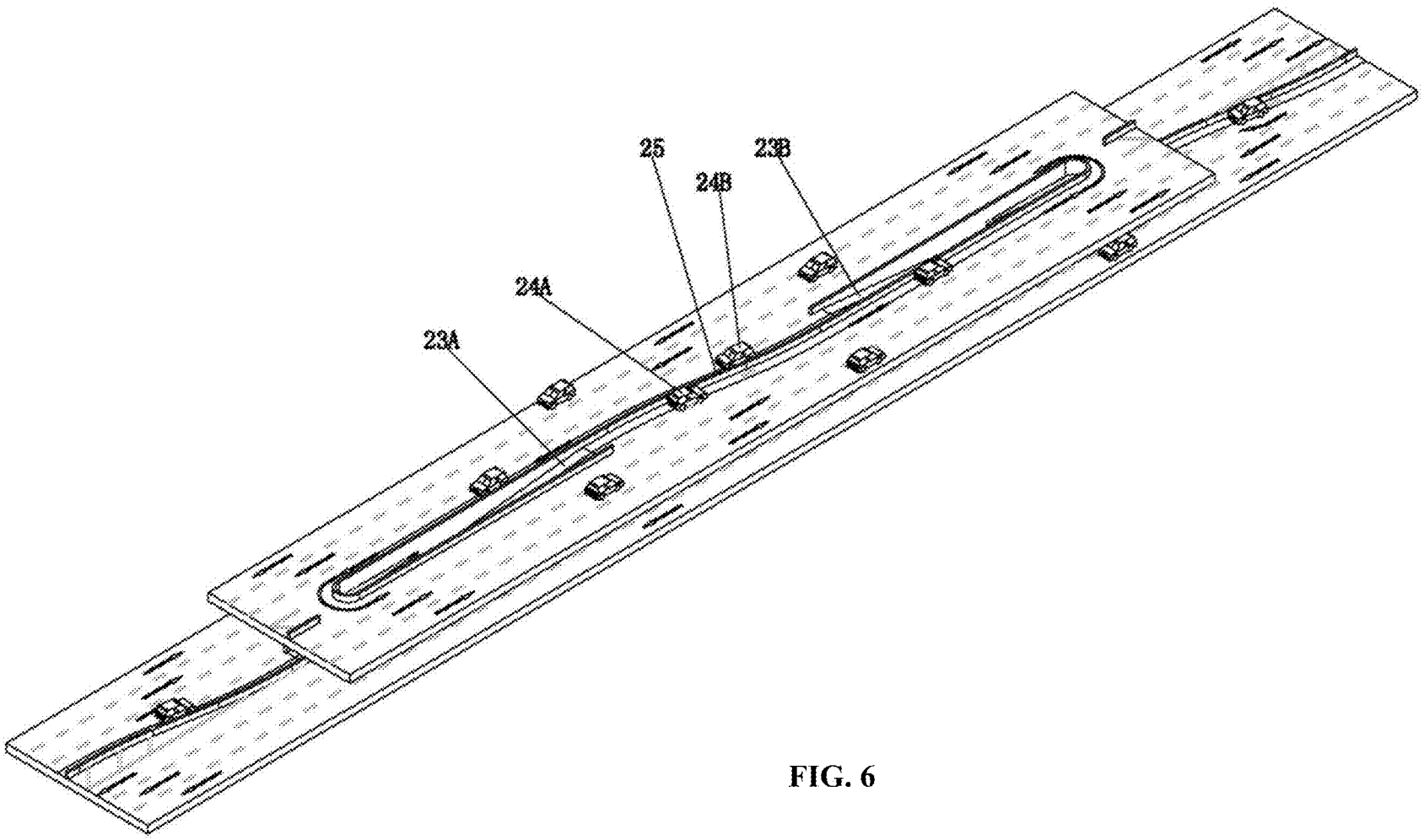

FIG. 6 shows a schematic view of the exit areas. This is a "two-in-one" composite exit, comprising two exits 23A and 23B, which are the exits from the left and right sides of the lower-layered road to the right and left sides of the upper-layered road, respectively. The two exits are separated by a separator 25. Openings of the two exits 23A and 23B are opposite to each other. Vehicles 24A and 24B from the left and right sides of the lower-layered road have already passed through the exits 23A and 23B on each side, and are ready to adjust the respective heads to drive into the right and left side of the upper-layered road, respectively.

FIGS. 7(*a*) and (*b*) show a side view and a top view of the exit areas in FIG. 6, respectively. It can be seen in figure (a) that a vehicle on the lower-layered road passes through four key points 26A, 26B, 26C and 26D, and travels from the lower-layered road to the upper-layered road through the exit. Similarly, a vehicle on the lower-layered road passes through four key points 27A, 27B, 27C and 27D and then travels to the upper-layered road through another exit. The states of the upward vehicles at the respective key points can be seen in figure (a) with reference to figure (b). At positions 26A and 27A, the vehicles are turning to change from a lane to another lane, so as to ready to enter the points of ramps. At positions 26B and 27B, the vehicles are upward traveling on the ramps. At positions 26C and 27C, the vehicles have left the upper exits and are turning right to adjust driving directions, so as to ready to enter the points of the upper-layered road. At positions 26D and 27D, the vehicles have completely entered the upper-layered road and then normally travel forward.

Figure 8:
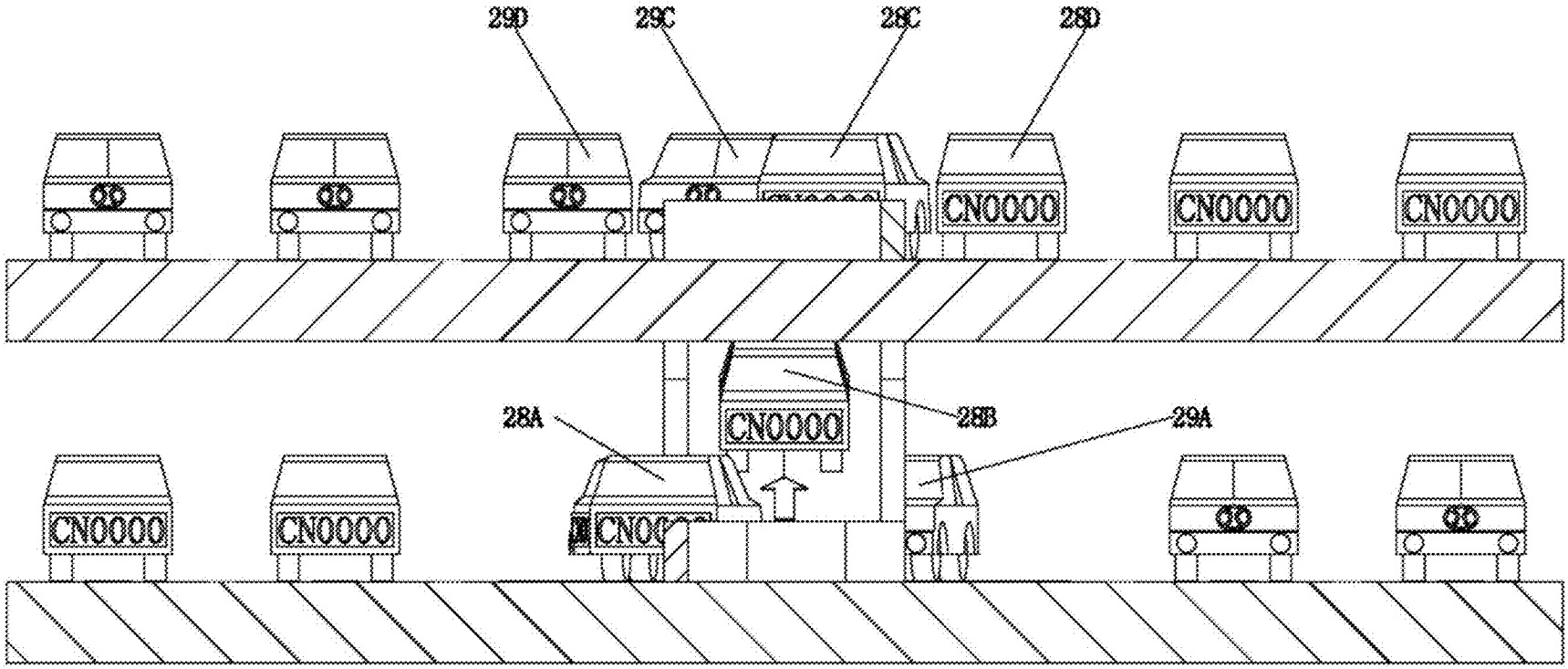

FIG. 8 shows a cross-sectional view of the exit area of FIG. 6, in which a vehicle driving from the lower-layered left side road into the upper-layered right side road through the ramp after passing through four key positions 28A, 28B, 28C and 28D. Similarly, a vehicle on the lower-layered right side road enters the upper-layered left side road through an invisible ramp on the opposite side after passing through several key positions, namely, a visible position 29A, an invisible upward position, and visible positions 29C and 29D.

Figure 9:
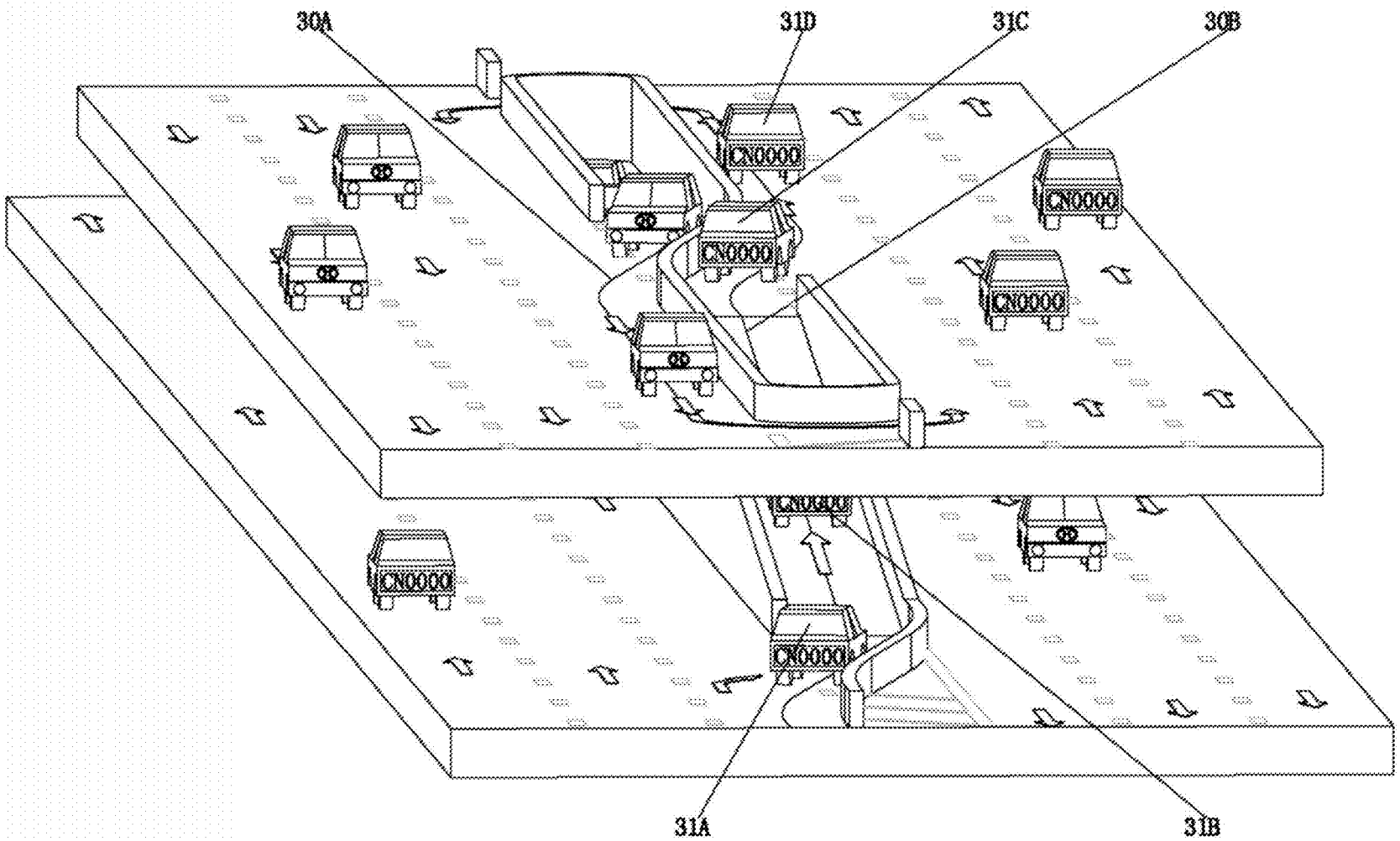

FIG. 9 shows another perspective view of the exit area of FIG. 6 in which up and down intercommunicating driving trajectories of vehicles can be relatively completely seen. In the figure, 30B indicates a right side upward trajectory along which a traveling vehicle turns right at position 31A, passes through position 31B in an upward ramp, turns right once again at position 31C, and travel onto the upper-layered road at position 31D. In addition to two straight lines on the upper-layered road and lower-layered road, the trajectory 30B has two lane changing curves and one upward ramp line. Similarly, the same is true of the other trajectory 30A. Vehicles follow the trajectories 30A and 30B to complete the intercommunication from the lower-layered road to the upper-layered road by two right turns and one upward ramp.

Figure 10:
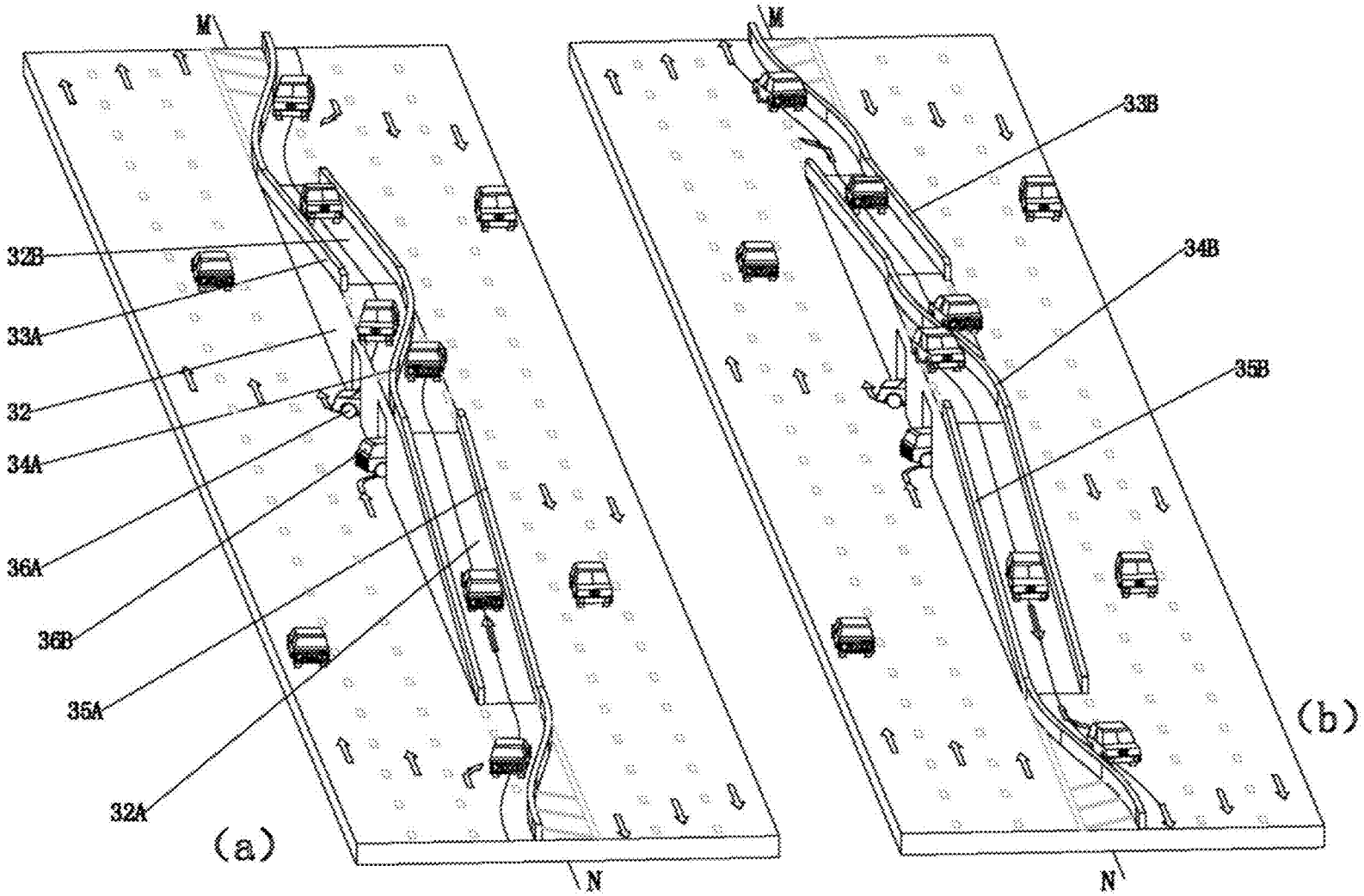
FIG. 10 illustrates the difference between the entrance areas and the exit areas according to the present invention.

FIG. 10 shows the lower-layered road and two kinds of trapezoidal sloping benches with the upper-layered road removed, in which figure (a) shows an exit sloping bench, and figure (b) shows an entrance sloping bench. Taking figure (a) as an example, the sloping bench 32 is installed at a centerline MN of the lower-layered road, two ramps 32A and 32B are arranged at two ends of the sloping bench, and guardrails on two sides of the ramps are of a one-piece structure. The guardrail 35A on one side of the ramp 32A is a composite guardrail connecting to a lower-layered guide rail, and a guardrail on the other side is a composite guardrail 34A connecting to the upper-layered separator. A guardrail 33A on one side of the ramp 32B is a composite guardrail connecting to the lower-layered guide rails, and there is a guardrail 34A on the other side. It can be found through the sloping bench of figure (b) with the sloping bench of figure (a) that the guardrails 33A, 34A and 35A of the entrance sloping bench and the guardrails 33B, 34B and 35B of the exit sloping bench are bilaterally symmetrical about the road centerline MN. Of course, it can be said that the exit sloping bench of figure (a) and the entrance sloping bench of figure (b) are exactly bilaterally symmetrical about the road centerline MN. Two U-turn passages are arranged at the lower parts of the sloping benches, and vehicles 36A and 36B are turning around.

Figure 11:
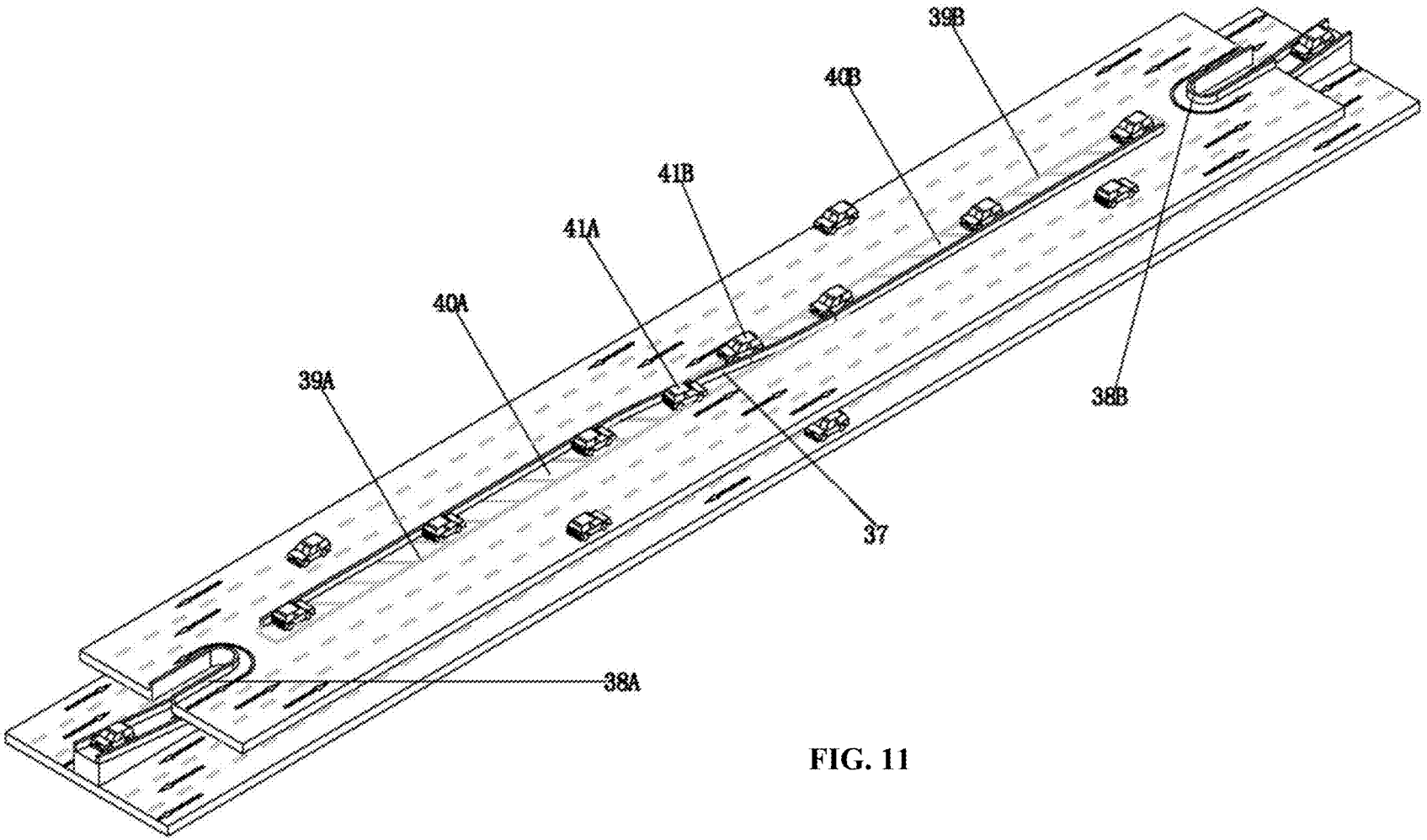
FIGS. 11 and 12 are schematic views of separation areas of the double-layered road unit according to the present invention.

FIG. 11 shows a schematic view of the separation area. The separation area is an area between the exit area and the entrance area, that is, a portion between an entrance fence 38A and an exit fence 38B in the figure. The separation area is provided with in-road parking area in a central region thereof, corresponding to the areas of the fences 38A and 38B, except for normal lanes on both sides of the separation area. The parking area is divided into two sections by a curved separator 37 and ground lines 39A and 39B, namely, a right side parking area 40A and a left side parking area 40B. The direction of the vehicle parked in the parking areas coincides with that of the vehicle on the own side, and vehicles 41A and 41B in the figure are ready to exit from the respective parking areas.

Figure 12:
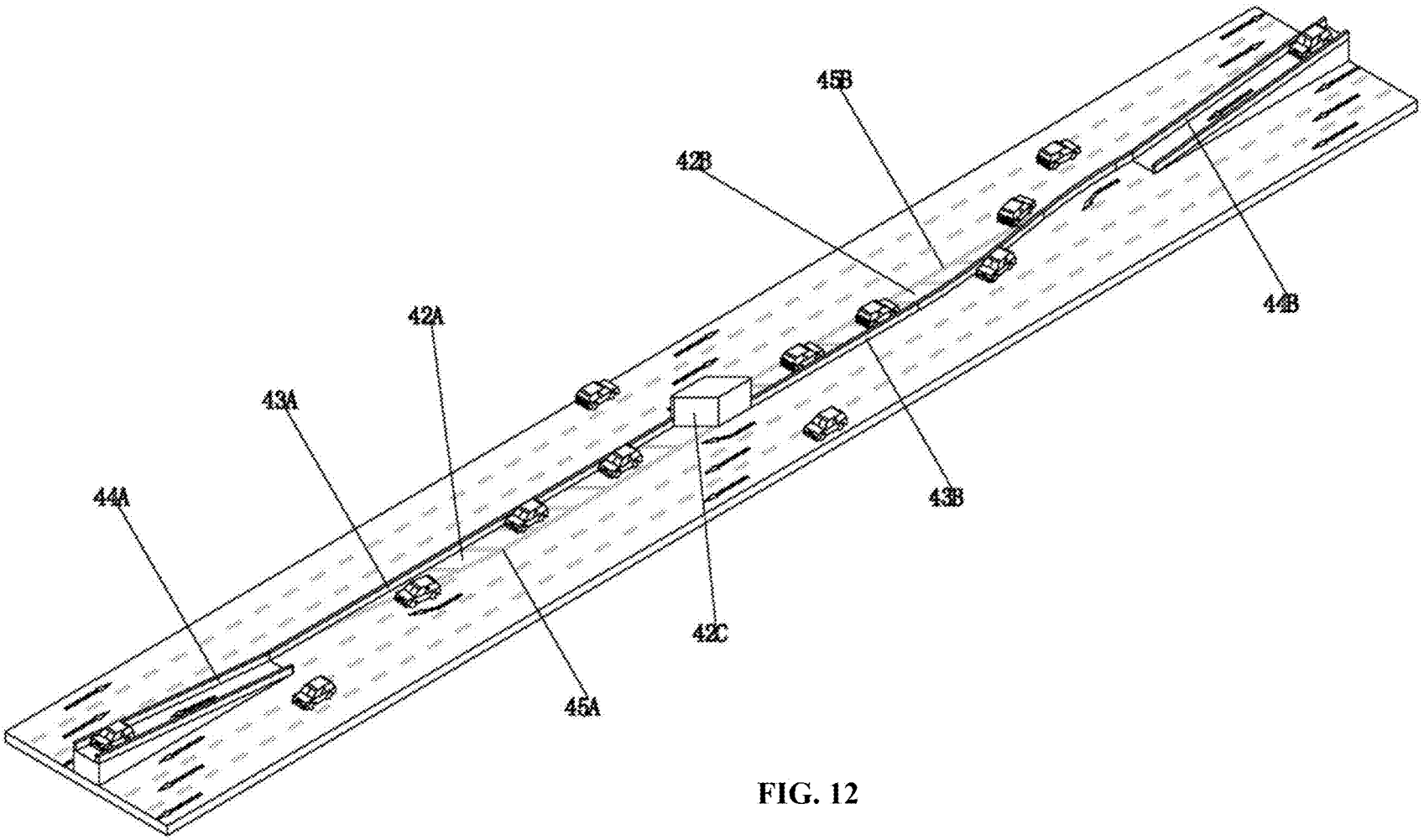

FIG. 12 shows the lower-layered separation area with the upper-layered road removed. A guardrail 44A on a side of a left sloping bench is connected to a separator 43A which is a straight rail. A guardrail 44B on a side of the right sloping bench is connected to a separator 43B which is a curved rail with a guide function. The separator 43A and a ground line 45A define a left parking area 42A, and the separator 43B and a ground line 45B define a right parking area 42B. The two parking areas are separated by a strut 42C.

Figure 13:
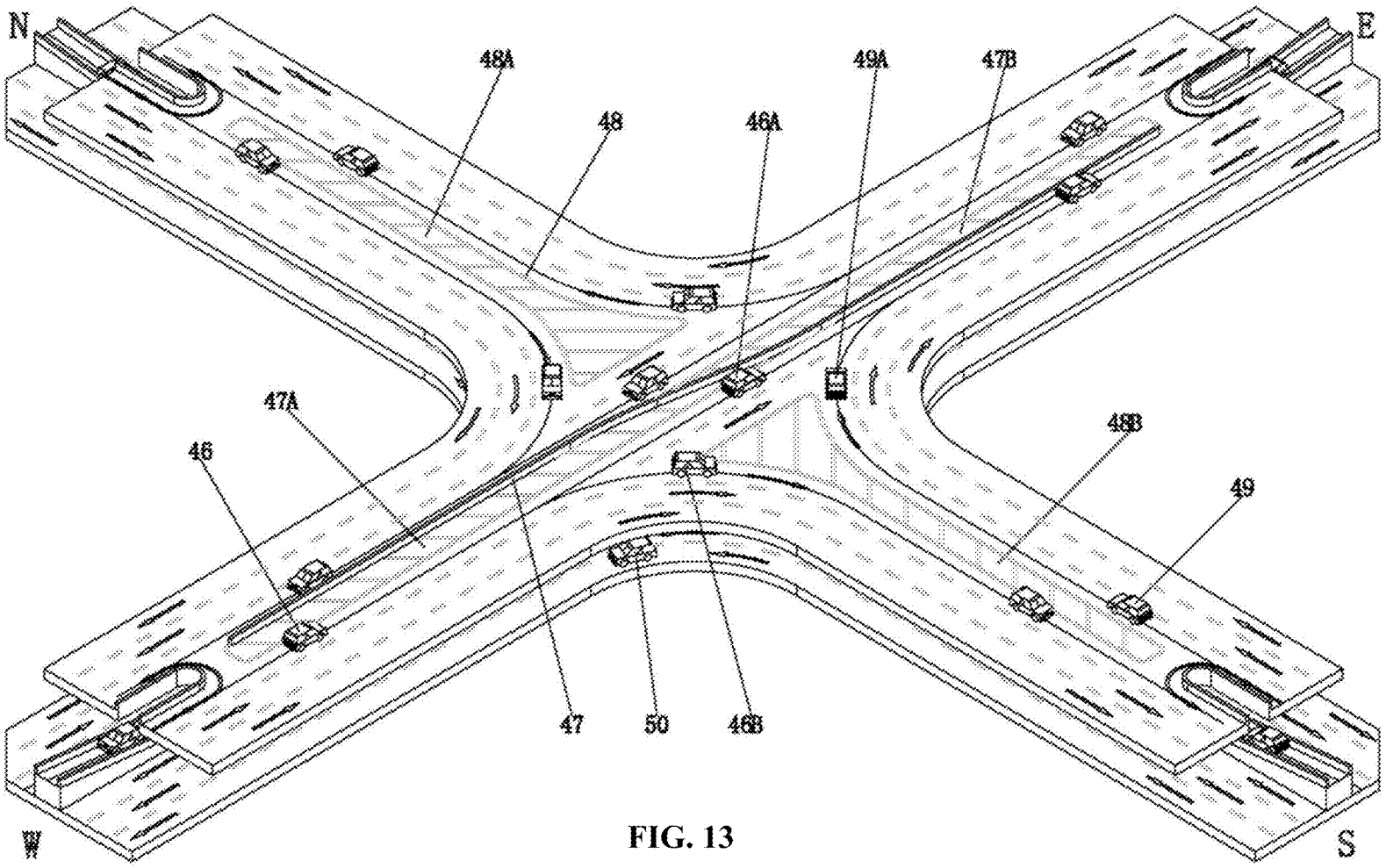
FIGS. 13 and 14 are schematic views of intersections of the double-layered road units according to the present invention.

FIG. 13 shows a schematic view of an intersection. The intersection is divided into an upper layer and a lower layer. Letters in the figure act as direction indicators, and respectively indicate: north-N, west-W, south-S, east-E. The present embodiment provides that vehicles on the upper layer follow the right-hand traffic rule, and vehicles are only allowed to run straight (in two cases, i.e., from east to west and from west to east), and to turn right (in four cases). The north-south straight run is interrupted by a separator 47. The upper layer of the intersection is also provided with a parking area in the road with isolating function. The separator 47, by virtue of its bending characteristics, delimits two parking areas 47A and 47B in cooperation with road surface markings. A closed curve line 48 delimits a further parking area 48A, which is also symmetrically arranged to be opposite to a parking area 48B. A vehicle 46 running from west to east may choose to go straight to position 46A and continue to go east, or may choose to turn right along a right turn trajectory to position 46B and go south. A vehicle 49 coming from south only can choose to turn right and go to east through position 49A. Vehicles on the lower-layered road follow the left-hand traffic rule with a left turn vehicle 50 being opposite in direction to a right turn vehicle 46B on the upper-layered road.

Figure 14:
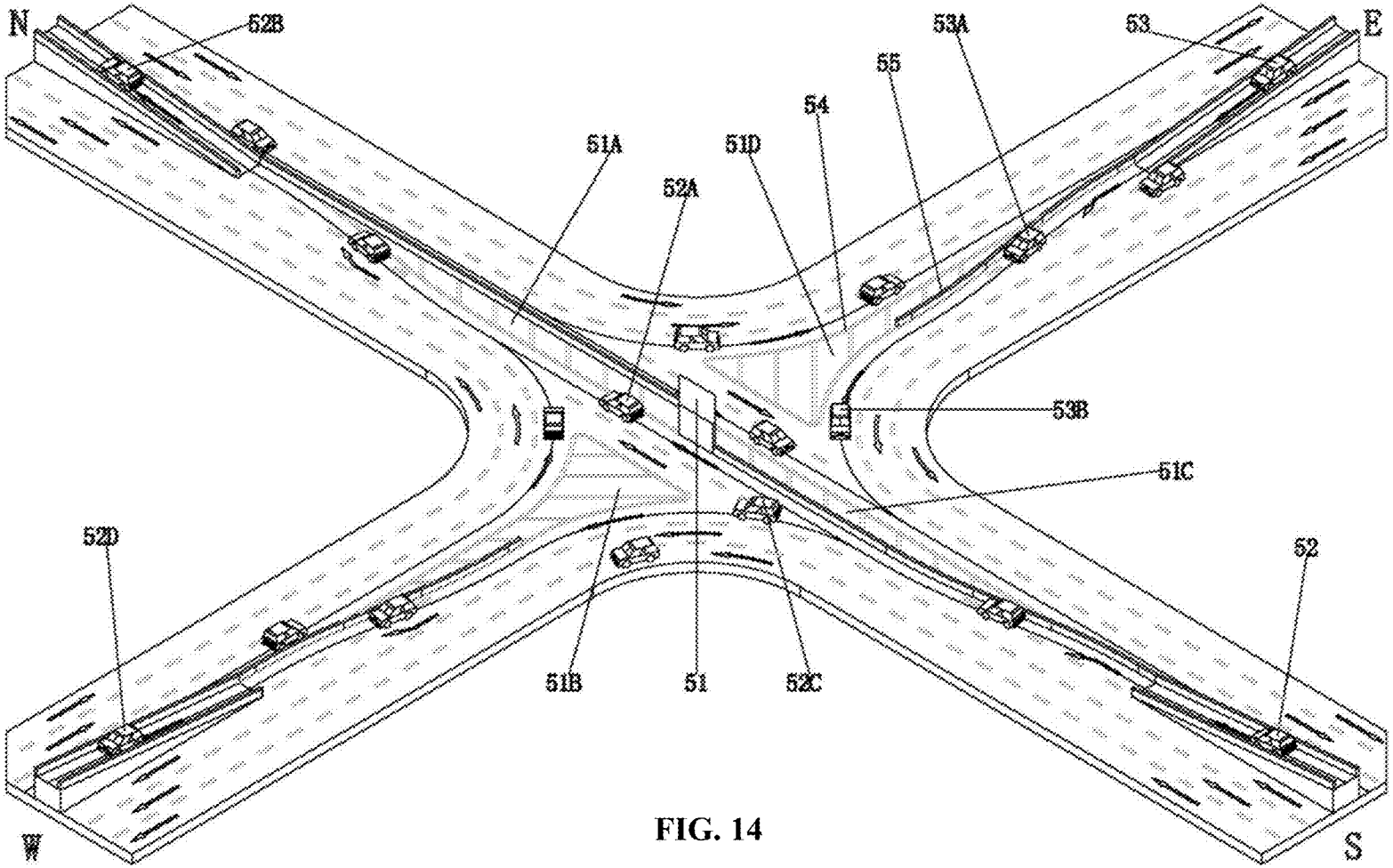

FIG. 14 shows a schematic view of a lower-layered intersection with the upper-layered intersection removed. Lower-layered vehicles follow the left-hand traffic rule, and vehicles are only allowed to run straight (in two cases, i.e., from north to south and from south to north), and to turn left (in four cases). The east-west straight run is interrupted by two parking areas 51A and 51C. In the middle of the parking areas, there is a pillar 51 supporting the upper-layered road. In addition, there are parking areas 51D which are delimited by closed curve lines 54 and guide rails 55, and symmetrically arranged parking areas 51B. A vehicle 52 running from the upper-layered road and through a south ramp can go straight to position 52A, and continue to go forward to the north, then run upward through position 52B on a north ramp to return to the upper-layered road, so as to finish straight run from south to north which cannot be realized on the upper-layered road. In addition, the vehicle 52 can turn left through position 52C, then go upwards from position 52D on a west ramp, to return to the upper-layered road, so as to finish left turn from south to west which cannot be realized at the upper-layered road. A vehicle 53 from an east ramp, after changing lanes through position 53A position, only can choose to turn left through position 53B, and then drive to the south.

The elevated left and right split driving double-layered road unit is more suitable for capacity expansion and reconstruction of existing arterial roads of old cities. This embodiment is applied in countries following the right-hand traffic rule. A lower layer of the double-layered road is an existing road, called a main layer where vehicles run according to the right-hand traffic rule. A newly-built elevated road is called an auxiliary layer where vehicles run according to the left-hand traffic rule. The elevated auxiliary layer, preferably dedicated to cars, is generally no more in road size than the main layer, and is narrower in road width than the main layer. Compared with typical left and right split driving double-layered road unit, the elevated road unit has different separation areas, and similar other parts such as entrances, exits and intersection. Thereby, only the separation areas will be described here.

Figure 15:
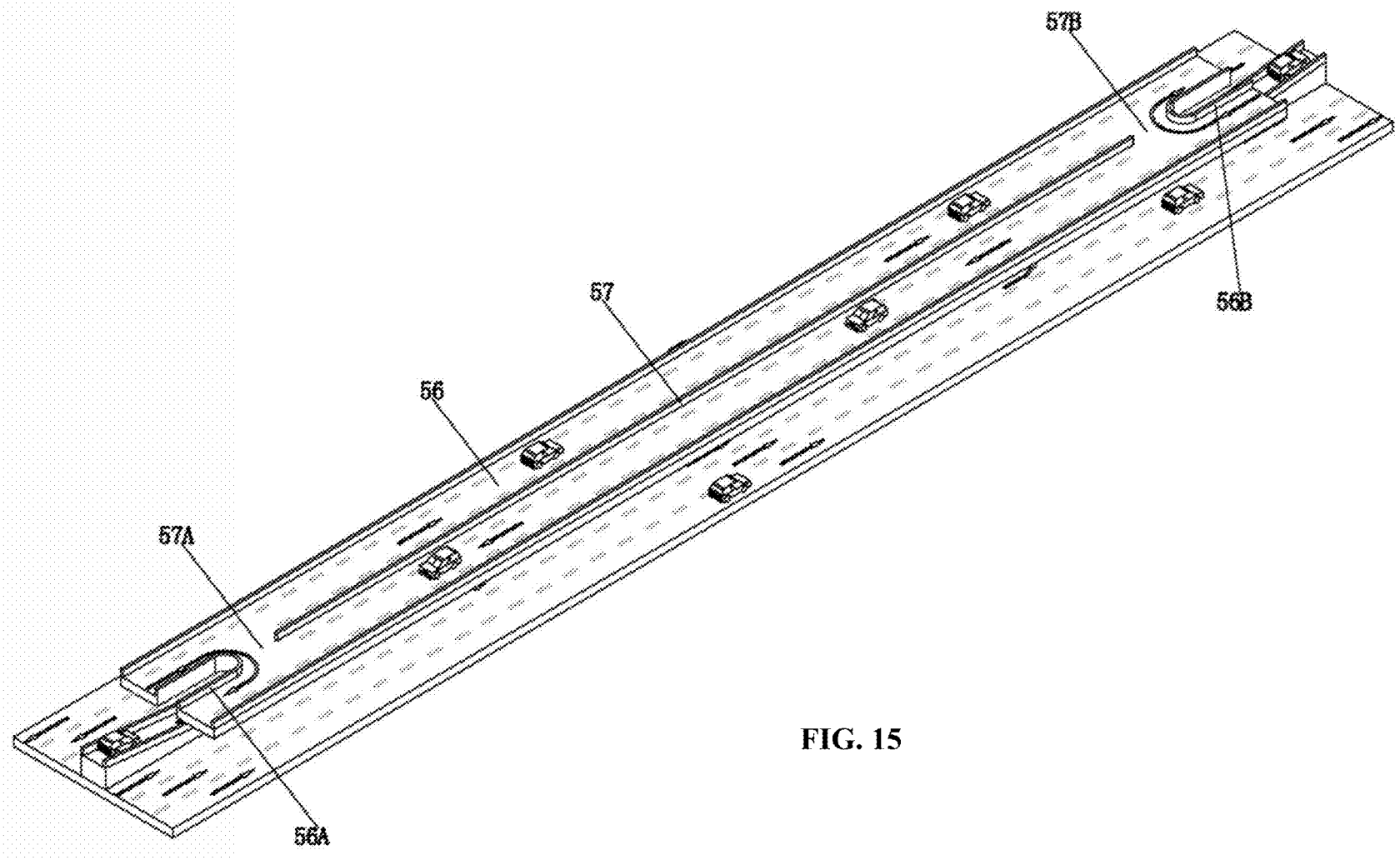
FIGS. 15 to 17 schematically show an elevated double-layered road unit.

FIG. 15 shows the separation area of the elevated left and right split driving double-layered road unit. Vehicles on the upper-layered road 56 travel according to the left-hand traffic rule. Compared with the typical left and right split driving double-layered road unit, the upper-layered parking areas are eliminated and are replaced with a straight separator 57 and two half-width lanes on either side thereof. Two U-turn areas 57A and 57B for turning upper-layered vehicles around are reserved between two ends of the separator 57 and fences 56A and 56B.

Figure 16:
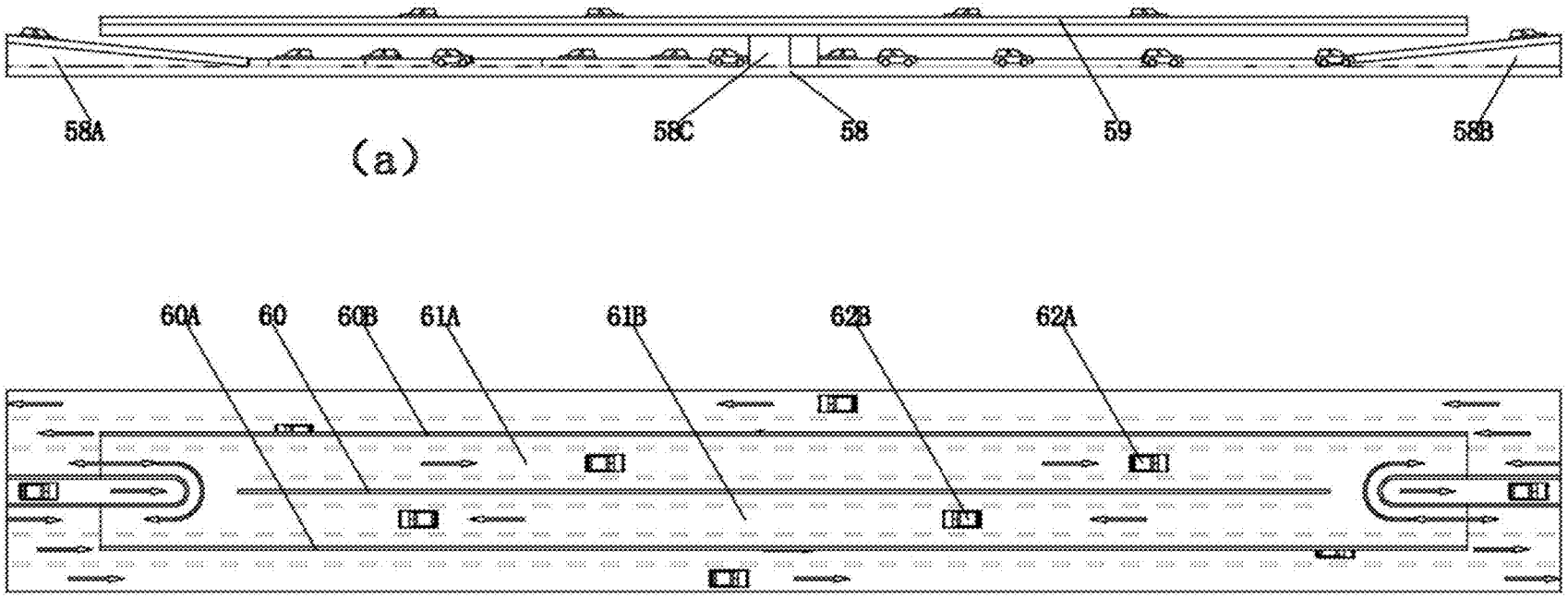

FIGS. 16(*a*) and (*b*) show a side view and a top view of the separation area of FIG. 15, respectively. The double-layered road structure and a pillar 58C supporting an upper-layered road 59 can be seen in the side view. Two ramps 58A and 58B are located on respective ends of a lower-layered road 58, and have the same direction of travel. The ramp 58A is a downward ramp and the ramp 58B is an upward ramp. Guardrails 60A and 60B at both sides of the upper-layered road and a middle separator 60 can be seen in the top view, and the guardrails and the separator divide the upper-layered road equally into two lane zones 61A and 61B. The upper-layered road in non-entrance areas and non-exit areas has a standard bidirectional four-lane width. However, the lane zones 61A and 61B are generally used as widened single lanes, and thus vehicles 62A and 62B centrally travel.

Figure 17:
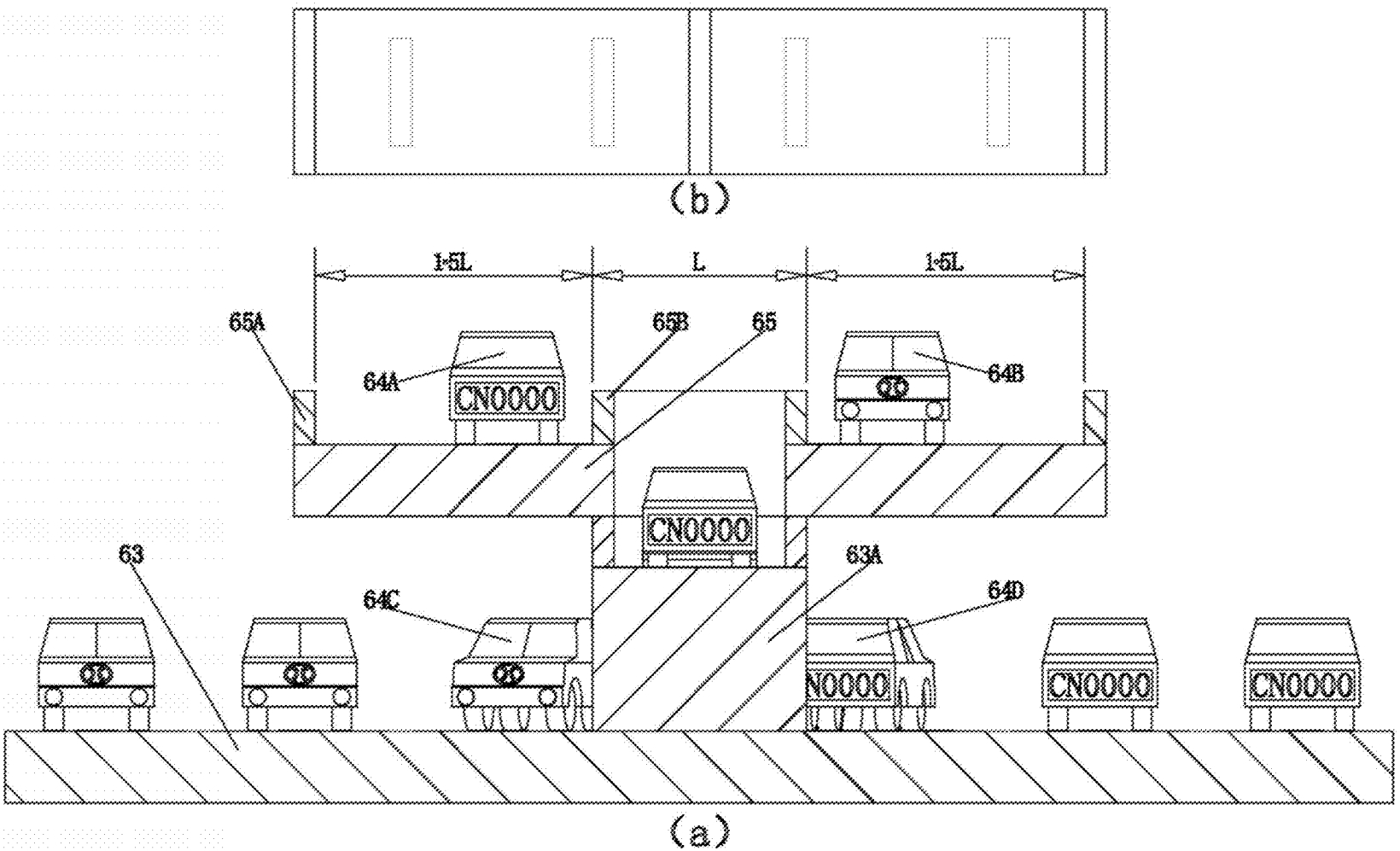

FIG. 17(*a*) shows a cross-sectional view of the separation area in FIG. 15, and figure (b) shows a top view of a small section of the upper-layered road. An elevated auxiliary layer 65 can be seen in figure (a), and has a smaller width than a ground main layer 63. There are invisible parking areas in the center of the ground, and vehicles 64C and 64D exiting the parking areas can be seen. A ramp 63A in the middle of the road is partially cut away and has a width L of one standard lane. A narrow section of the upper-layered road corresponds to a distance between a side guardrail 65A and a middle fence 65B, which is 1.5 times of a standard lane width L, so that in the event of a broken car in the front, cars at the back can pass through at a low speed. The distribution characteristics of the lanes can be seen by comparing figure (b) with figure (a): the upper-layered road has two sections, wide and narrow, and has two road widths in which the wide section with a width of 2L has no entrance or exit fence, and the narrow section with a width of 1.5L has entrance and exit fences.

A sunk left and right split driving double-layered road unit is particularly suitable for newly-built urban roads and needs to be wholly planned and designed in advance. Generally, the ground is used as a main-layered road, and an underground layer is used as an auxiliary layer. Taking China as an example, the main-layered road on the ground works according to the right-hand traffic rule, and the auxiliary-layered road under the ground works according to the left-hand traffic rule.

Figure 18:
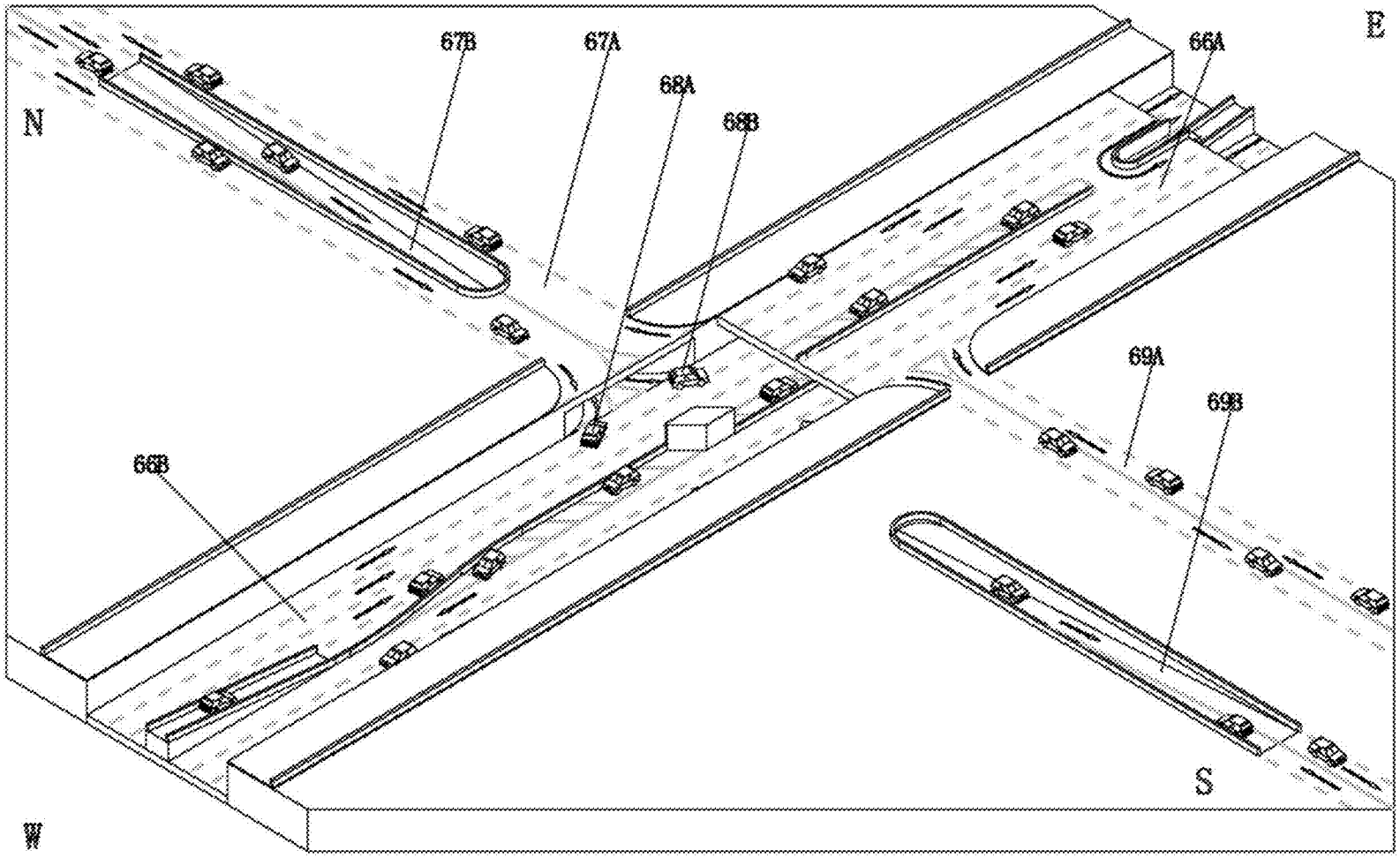
FIGS. 18 to 20 schematically show a sunk double-layered road unit.

FIG. 18 shows a section of a sunk composite road unit in which an arterial road is composed of an upper-layered road 66A and a lower-layered road 66B with a left side of the upper-layered road 66A being cut away. There are residential areas on north side (N) and south side (S), and branch roads in the residential areas are all non-layered planar roads. Taking south side (S) as an example, a branch road 69A leads to an upper layer 66A of the arterial road, and both of them follow the right-hand traffic rule. A branch road 69B leads to a lower layer 66B of the arterial road, and both of them follow the left-hand traffic rule. On south side (S), a branch road 69A following the right-hand traffic rule and a branch road 69B following the left-hand traffic rule are separately arranged. On north side (N), a branch road 67A following the right-hand traffic rule and a branch road 67B following the left-hand traffic rule are integrally arranged, such that two lanes of north to south and south to north of the branch road 67A are arranged on the left and right sides of the branch road 67B, respectively. It can be seen in the figure that a vehicle 68A is turning left to exit the lower layer 66B of the arterial road and to enter the branch road 67B following the left-hand traffic rule, and a vehicle 68B from the branch road 67B following the left-hand traffic rule just turns left to enter the lower layer 66B of the arterial road.

Figure 19:
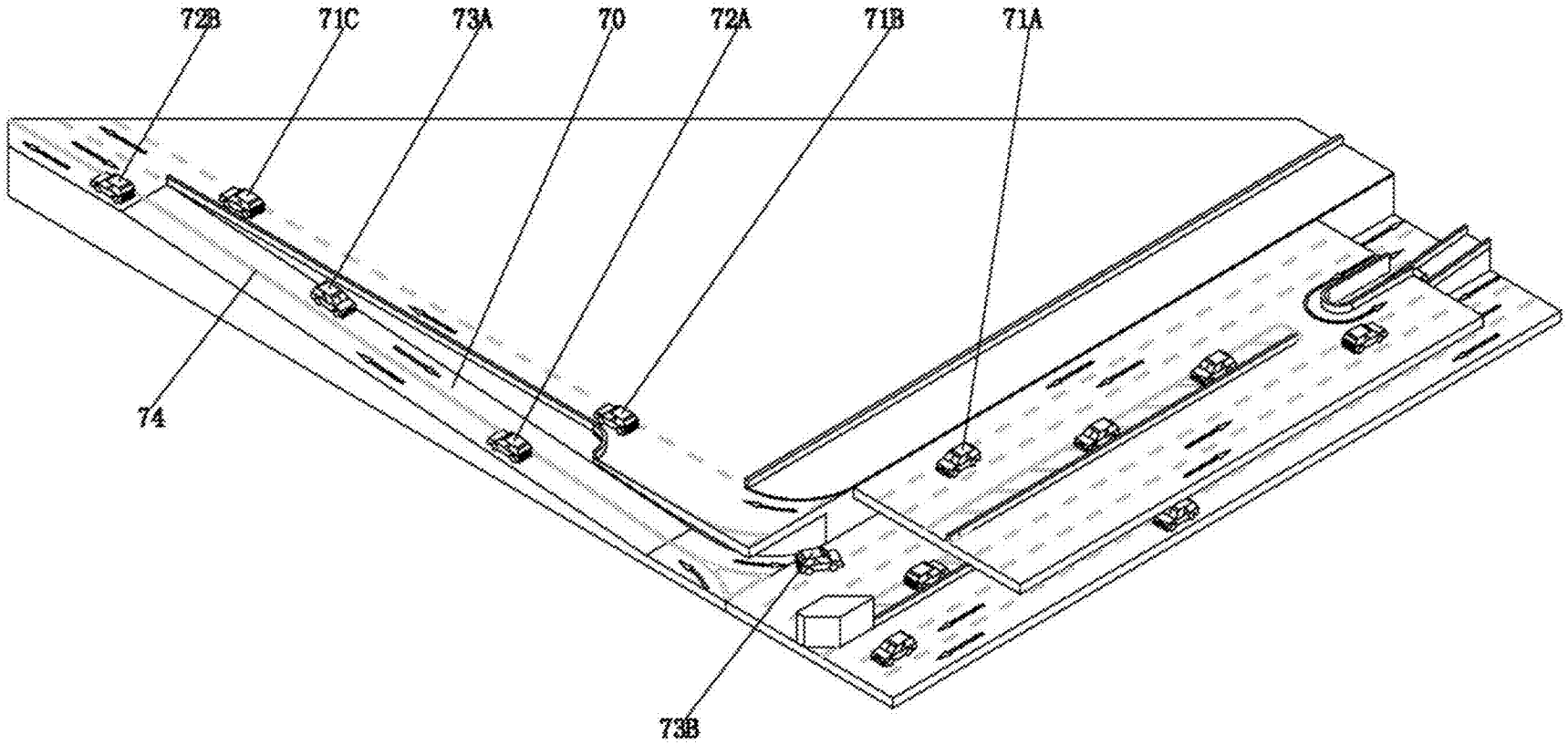

FIG. 19 shows a partial cut-away view of the sunk composite road unit of FIG. 18, in which a branch road 70 can be seen. The road is divided, by a solid white line 74 in the middle of the road, into two parts, one for ascending vehicles, and another for descending vehicles. A vehicle drives from the lower layer of the arterial road to the ground through a branching road 70 following the left-hand traffic rule, with two positions 72A and 72B located in its traveling path. Another vehicle enters the lower layer of the arterial road from the branching road 70 following the left-hand traffic rule, with two positions 73A and 73B located in its traveling path. A further vehicle turns right from the upper layer of the arterial road to enter a branching road following the right-hand traffic rule, with three positions 71A, 71B and 71C located in its traveling path.

Figure 20:
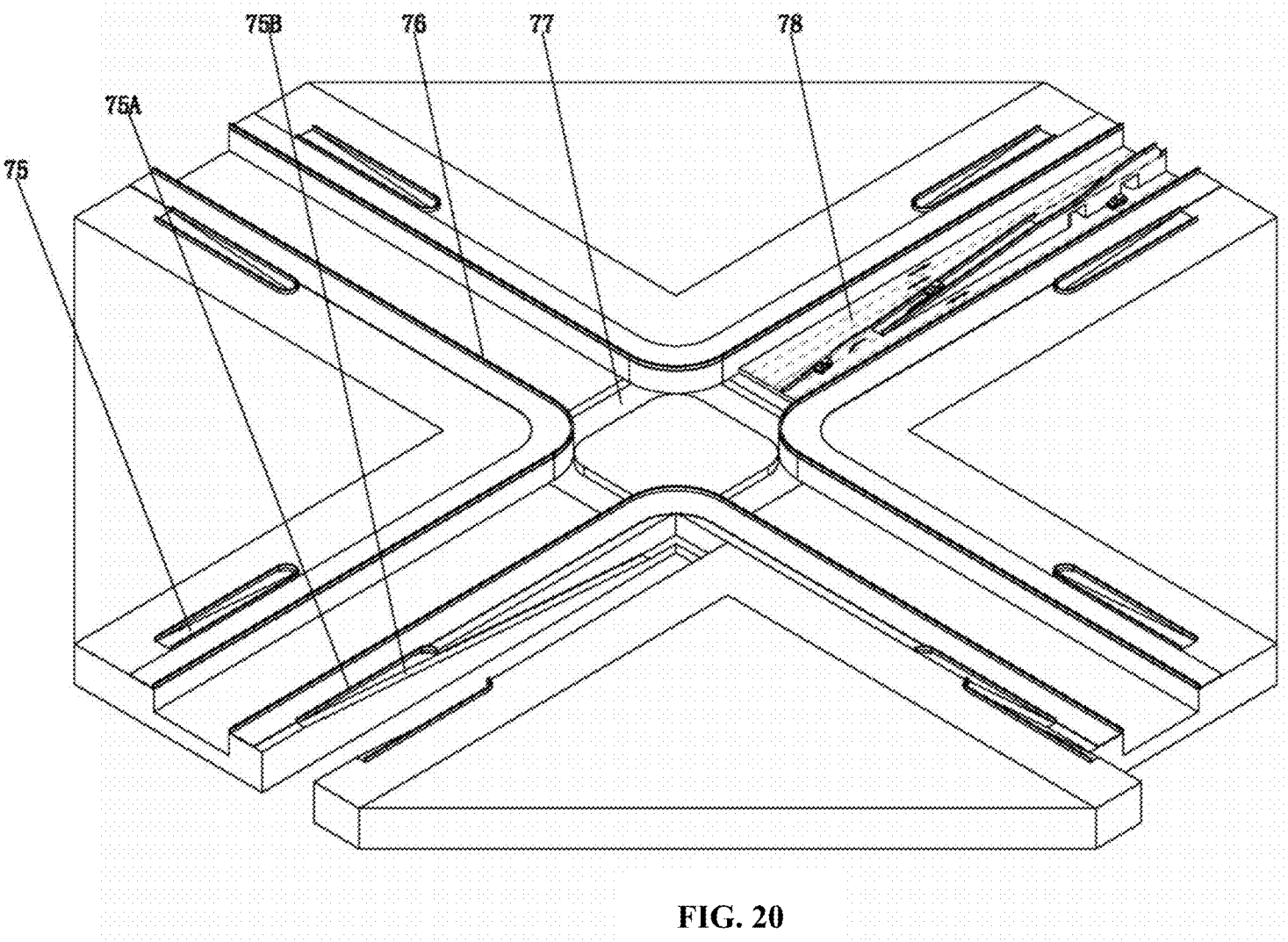

FIG. 20 shows an intersection of a sunk composite road unit in which it is required to entirely isolate persons from vehicles. For this purpose, four sets of separators 76 are provided at the intersection, and eight pedestrian underpasses similar to a pedestrian underpass 75 are correspondingly provided. Pedestrians may reach a ring corridor 77 in an underground second level through ramps 75B of the underpasses, and the entrances of the underpasses are provided with guardrails 75A. A lower layer 78 of the double-layered road is on one level below ground, and the ring corridor 77 is on a lower level below the lower layer 78.

Figure 21:
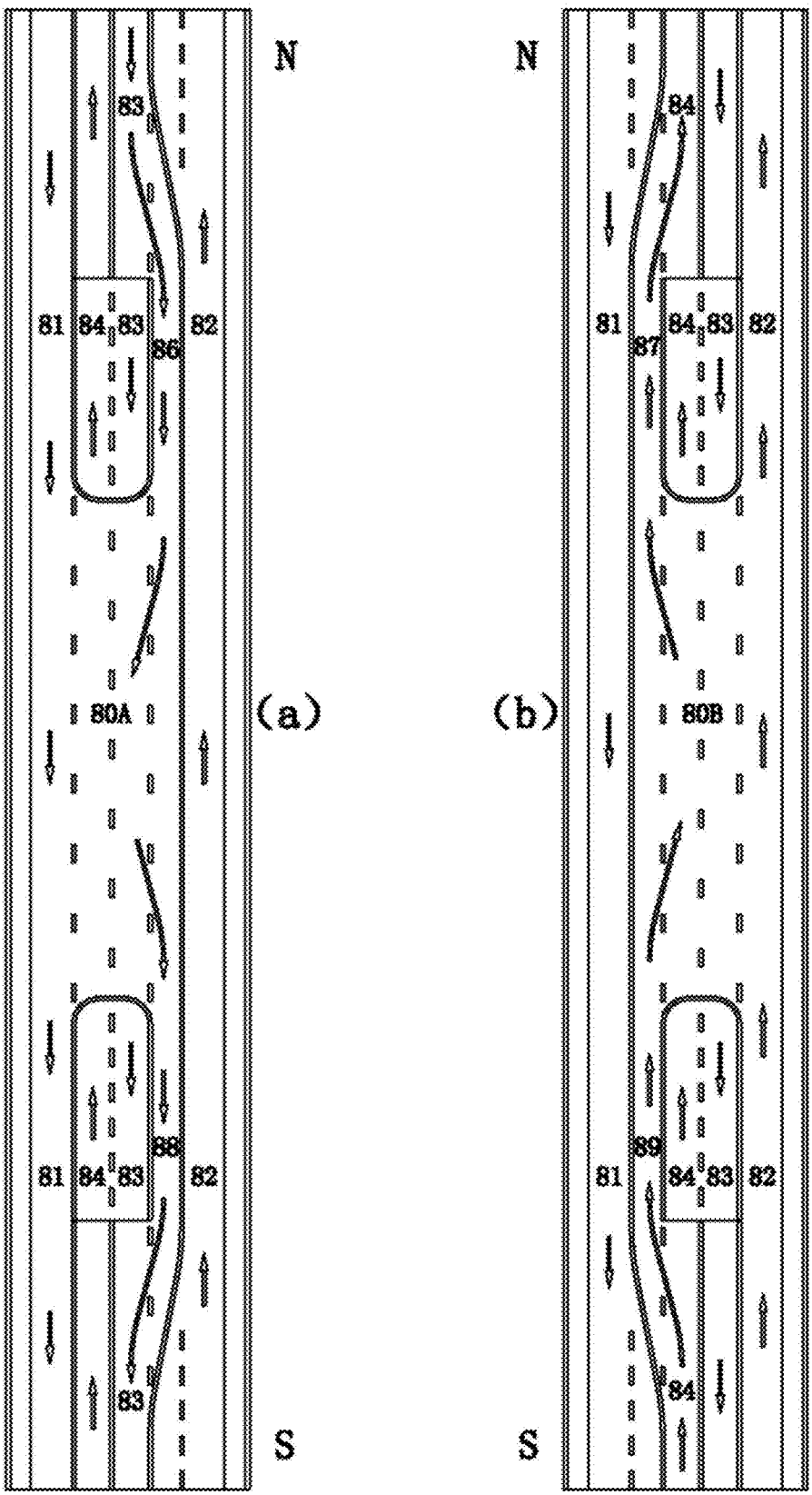
FIGS. 21 and 22 schematically show another embodiment of a composite road unit according to the present invention, the composite road unit being a planar road unit.

FIGS. 21(*a*) and (*b*) show connection of the passages of the planar composite road module. The first road is a road including a first lane 81 and a second lane 82 and following the right-hand traffic rule, and the second road is a road including a third lane 83 and a fourth lane 84 and following the left-hand traffic rule. The second road is located between the first lane and the second lane of the first road. In order to achieve intercommunication of the first road and second road, two road-changing overpasses 80A and 80B are formed at a non-intersection section (i.e. a road section) of the roads. The second road is sunk below the ground at the road-changing overpasses. A first connecting passage 88 bypasses a lower port of the road-changing overpass 80A to intercommunicate the first lane to the third lane, a second connecting passage 87 bypasses an upper port of the road-changing overpass 80B to intercommunicate the second lane to the fourth lane, a third connecting passage 86 bypasses an upper port of the road-changing overpass 80A to intercommunicate the third lane to the first lane, and the fourth connecting passage 89 bypasses a lower port of the road-changing overpass 80B to intercommunicate the fourth lane to the second lane. It will be conceivable for those skilled in the art that the second road may also be elevated above the ground at the two road-changing overpasses.

Figure 22:
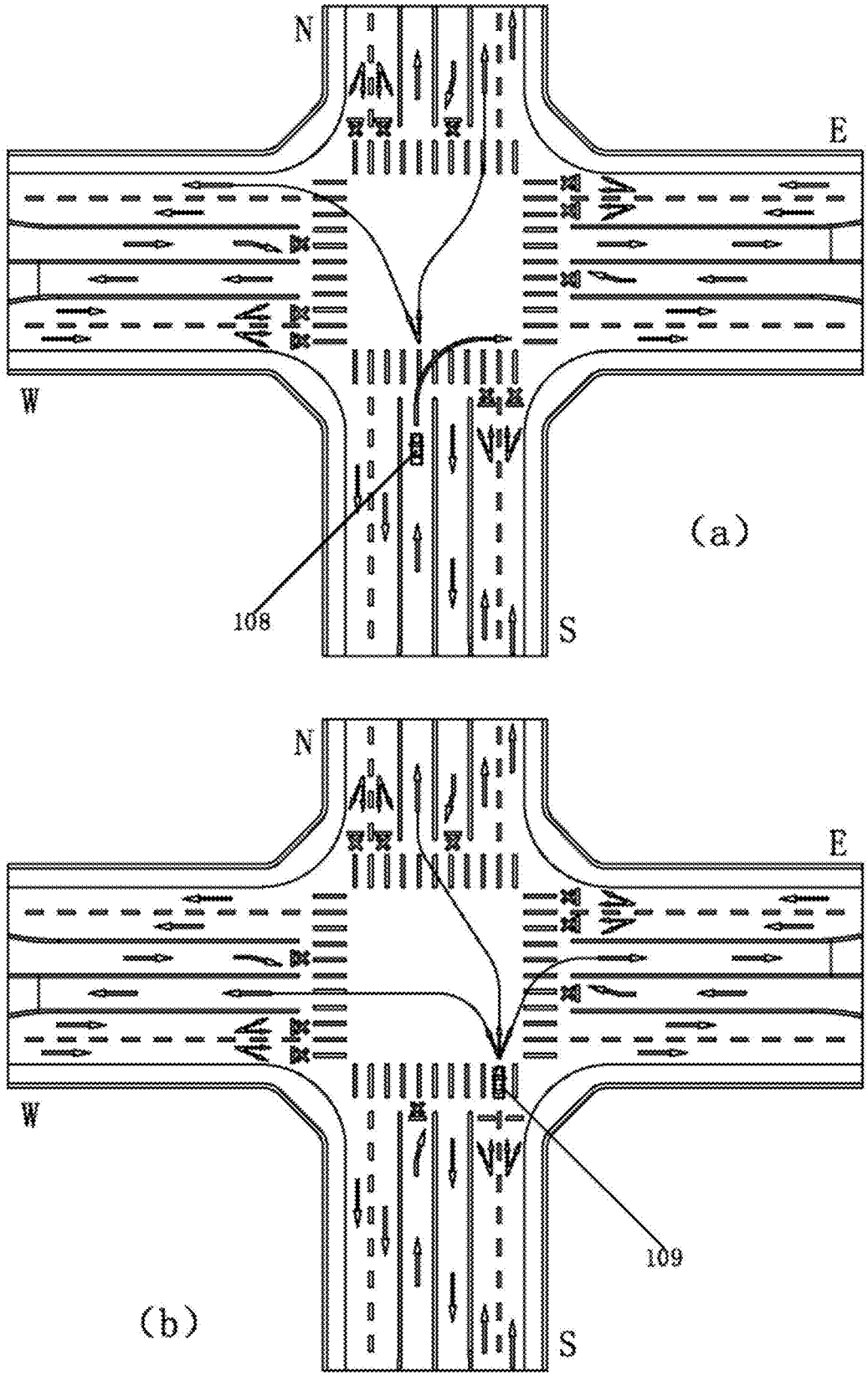
Figure 23:
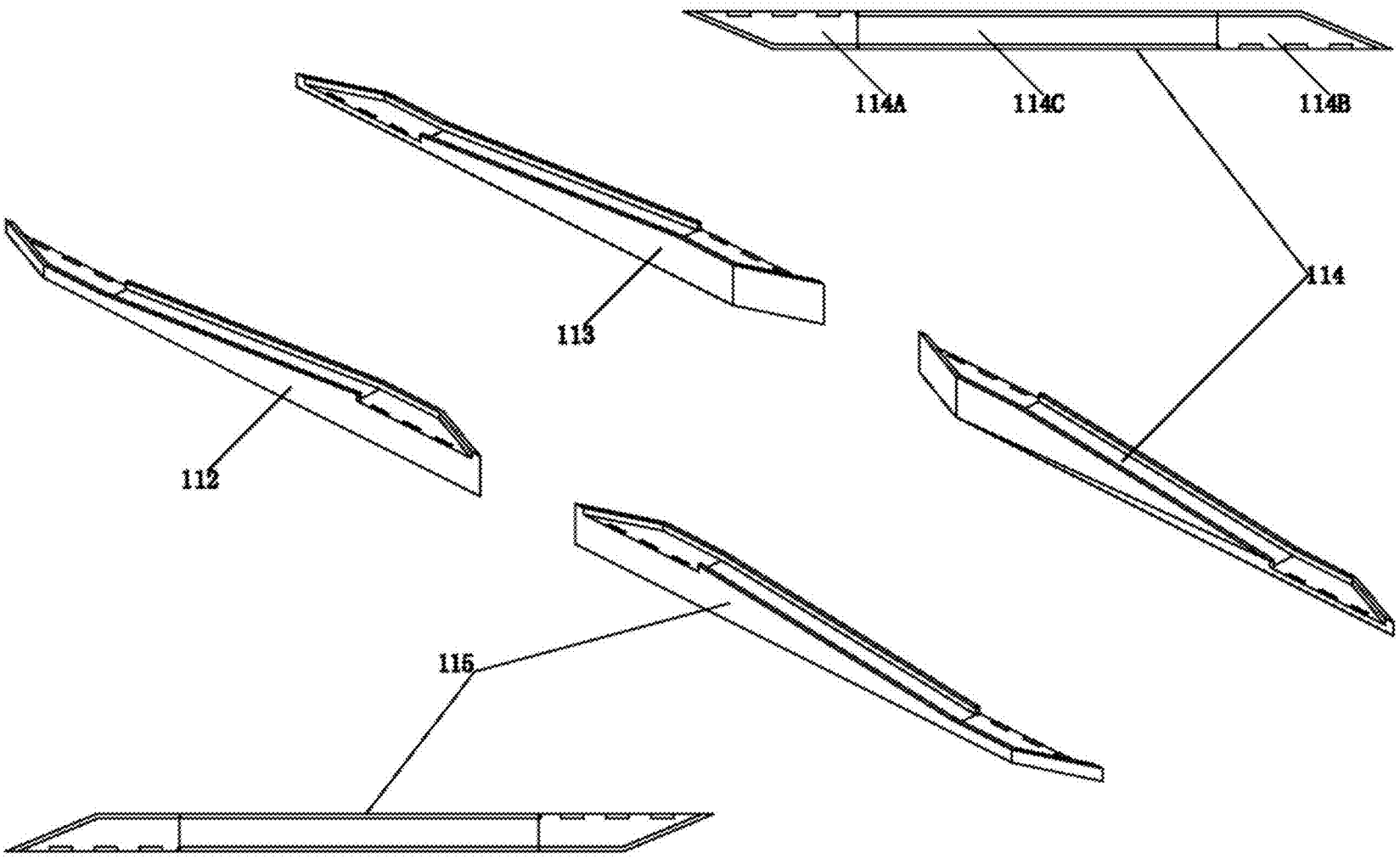
FIGS. 23 to 28 schematically show communication manners of the double-layered road unit according to the present invention.

FIG. 22 schematically shows another communicating manner of a planar composite road unit. In this manner, communications of various passages are accomplished at intersections at both ends of the composite road module. For example, in figure (a), a vehicle 108 coming from a fourth lane on the south side and readying to travel off the second road, enters the first lane of the first road on the east side in a manner of turning right, and may also enter the first lane of the first road on the north side or the west side in the manner of advancing or turning left. In figure (b), a vehicle 109 coming from the second lane on the south side and readying to travel off the first road, may enter the third lane of the second road on the north, west and east sides in a manner of advancing, turning left and turning right, respectively. In this way, intercommunication between a first road of one composite road module and a second road of another composite road module is achieved. FIG. 23 shows schematic structural views of an intercommunicating ramp set for a double-layered composite road module. To meet four types of requirements for "diagonal communication" of four passages, four sloping benches 112, 113, 114, 115 are prepared. The four sloping benches are similar in structure, but are different from one another in orientations of openings and height positions of the openings. Basic structure of the sloping benches is similar to the sloping bench 114 consisting of three parts, namely a high platform 114A, a low platform 114B and a ramp 114C. Except for an opening with a dashed line, guardrails are arranged to surround sides of the platforms and the ramp. The openings of the high platform and the low platform are positioned at the front end and the rear end of the ramp and are arranged on the left side and the right side.

Figure 24:
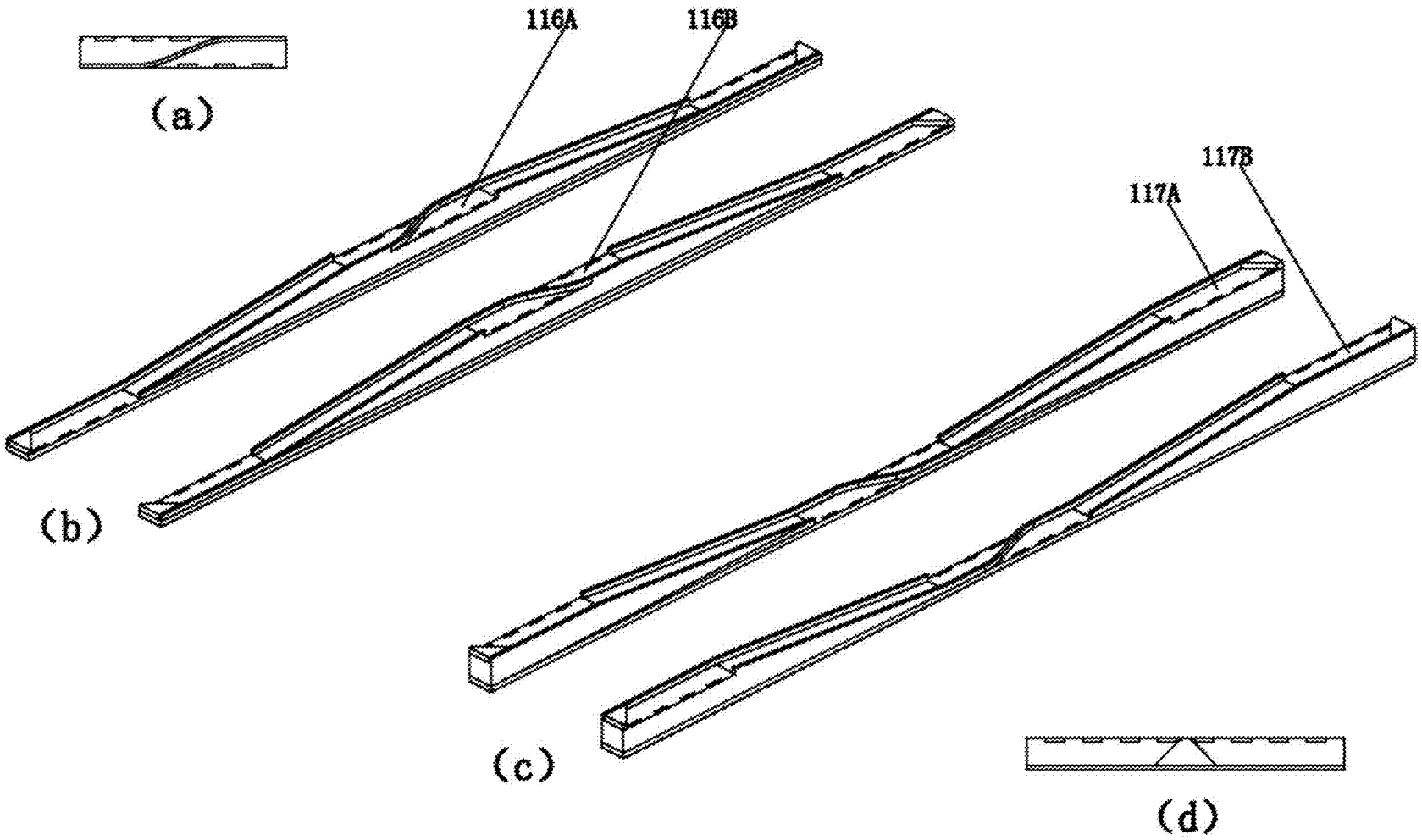

FIG. 24 schematically shows two types of intercommunicating ramp sets. A complete set of intercommunicating ramps has four ramps and four platforms. The platforms are classified into high platforms and low platforms according to their different positions; the platforms are classified into different-side opening platforms and same-side opening platforms according to their different structures. Figure (a) shows a platform with openings on different sides, wherein the openings are arranged at positions indicated by dashed lines on two sides of an oblique separator, and two openings are positioned on left and right sides, and are staggered from front to back. Figure (d) shows a platform with openings on same side, wherein two openings are positioned on the same side of the separator and are spaced apart by a triangular stop block. Figure (b) and figure (c) show two types of intercommunicating ramp sets comprising two high platforms, two low platforms and four ramps, the structures of which can be decomposed into two sections A, B. The section B is a mirror-symmetrical structure of section A along a longitudinal axis and the two sections A and B are connected end to end to form a complete intercommunicating ramp set. Figure (b) shows two unit sections 116A and 116B of the high platform with openings on different sides, and figure (c) shows two unit sections 117A and 117B of the high platform with openings on the same side.

Figure 25:
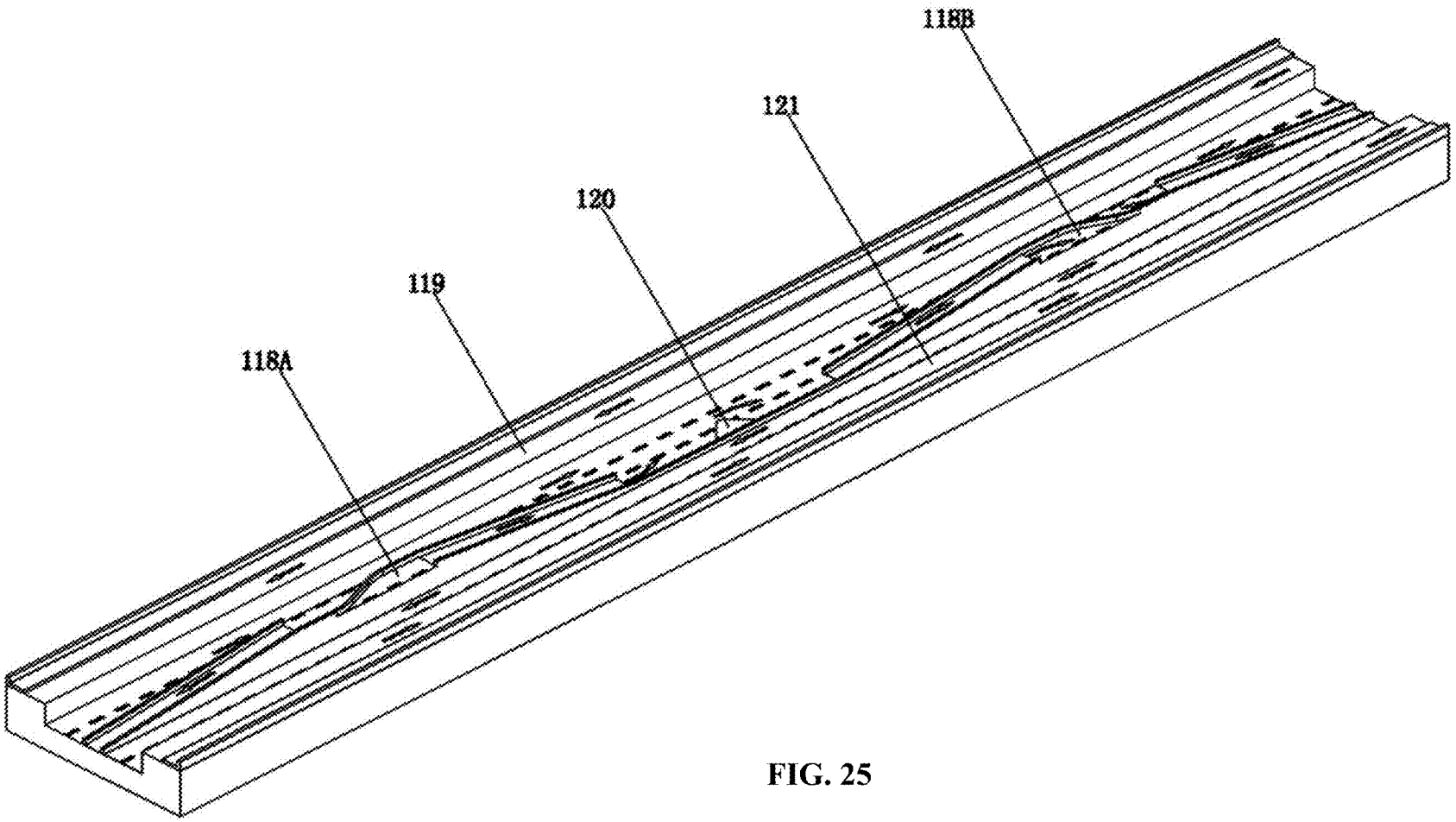

FIG. 25 shows a partial schematic view of a double-layered road module with a second, lower-layered road being sunk. A part of the upper-layered road is removed from the figure for clarity. The left-hand traffic rule of the lower layer road can be seen from marked lines on the road surface. An intercommunicating ramp set is positioned in the middle of the lower-layered road, and has a high platform with openings on different sides. It can be seen that platforms 118A and 118B with openings on different sides are flush with the upper-layered road surface, and there is a lower platform 120 with openings on a same side between the two platforms. It can be also seen in the figure that two outermost lanes 119 and 121 of the upper-layered road follow the right-hand traffic rule.

Figure 26:
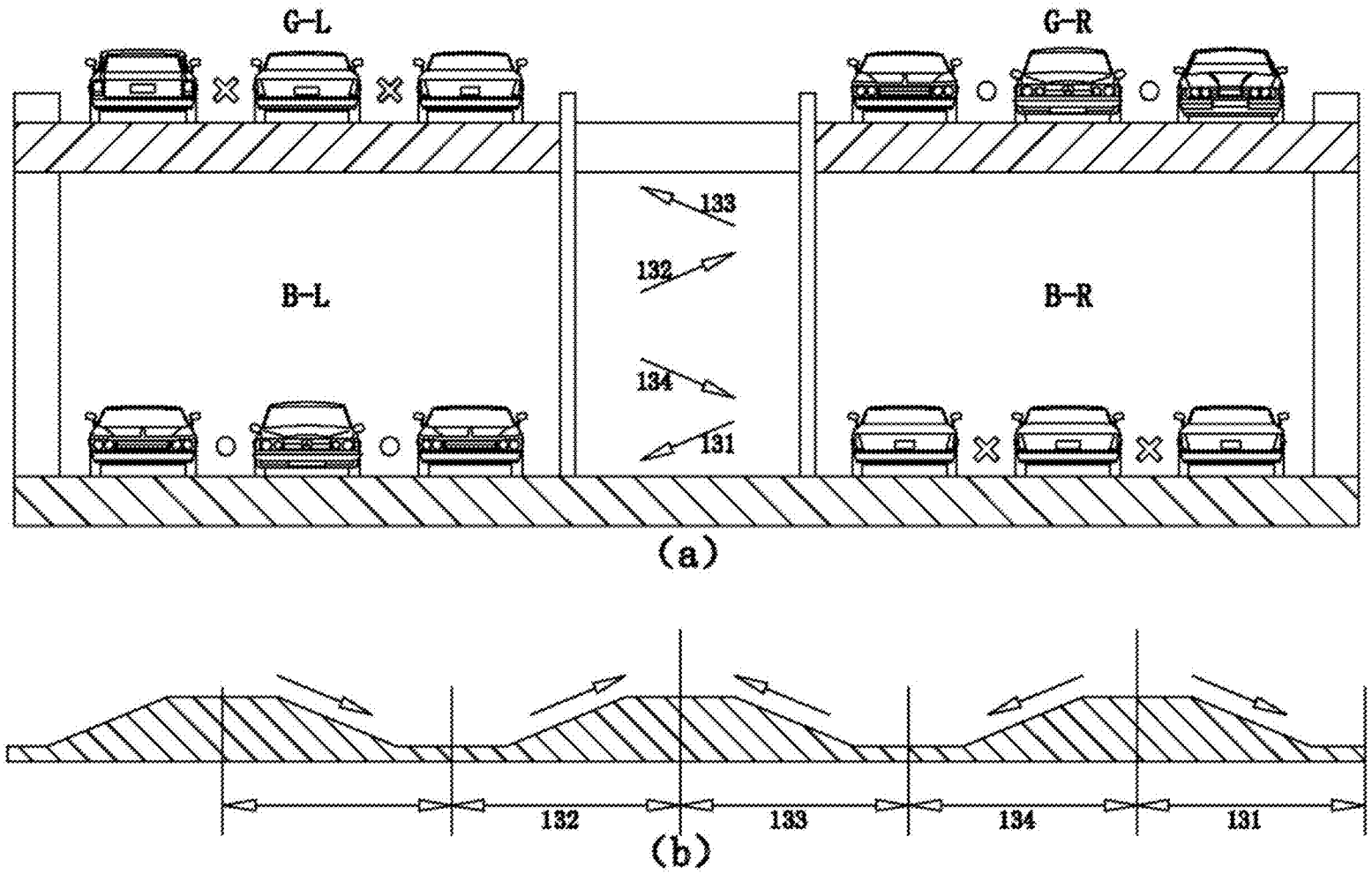

FIGS. 26(*a*) and (*b*) show a cross-sectional view and a longitudinal-sectional view of an elevated double-layered composite road module, respectively. In figure (a), upper-layered vehicles run according to the right-hand traffic rule, and lower-layered vehicles run according to the right-hand traffic rule. There is an intercommunicating ramp set in the middle of figure (a), and pillars are arranged on two sides. Due to mixed movement of small-typed and large-typed vehicles, the height of roads and overpasses, as well as that of intercommunicating ramp sets, are designed according to a large size. A forward direction going in the figure is indicated by a sign "x", and a reverse direction going out of the figure is indicated by a sign "O". Figure (b) shows the basic structure and functional areas of the intercommunicating ramp set. Partial functional units of the ramp set are the parts from a middle line of a high platform to a middle line of an adjacent low platform, and complete functional units comprise four continuous partial functional units of a reverse downward interval 131, a reverse upward interval 132, a forward upward interval 133 and a forward downward interval 134. The composite road module comprises an upper left road board G-L (or called a second lane), an upper right road board G-R (or called a first lane), a lower left road board B-L (or called a third lane) and a lower right road board B-R (or called a fourth lane). The four-area and four-direction diagonal connecting passages have four groups, and they are combined as follows: the first lane G-R to the third lane B-L correspond to the reverse downward interval 131, the third lane B-L to the first lane G-R correspond to the reverse upward interval 132, the fourth lane B-R to the second lane G-L correspond to the forward upward interval 133, and the second lane G-L to the fourth lane B-R correspond to the forward downward interval 134. It can be found that connecting passages in the intervals 132 and 133 lead to the first lane and the second lane, respectively, and thus exits of these two connecting passages are located on both sides of the corresponding separator in the upper-layered road. Likewise, connecting passages in the intervals 134 and 131 come from the second lane and the first lane, respectively, and thus entrances of these two connecting passages are also located on both sides of the corresponding separator in the upper-layered road. However, connecting passages in the intervals 133 and 134 come from and lead to the fourth lane, respectively, and thus an entrance of the former connecting passage is located on the same side of the corresponding separator in the lower-layered road as an exit of the latter connecting passage.

Figure 27:
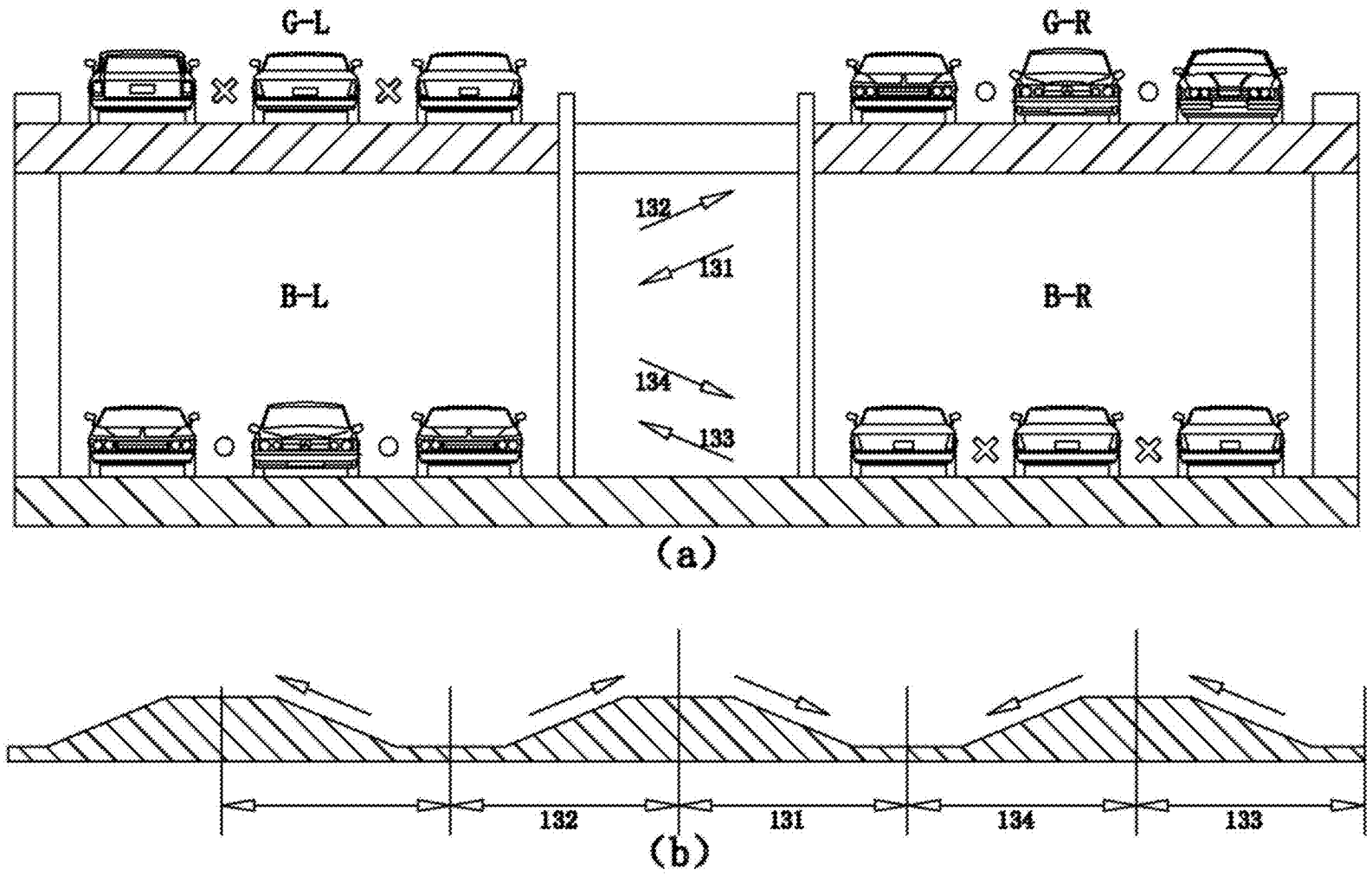

FIG. 27 is similar to FIG. 26, except for the arrangement of the connecting passages. In particular, the connecting passages in the intervals 132 and 131 lead to and come from the first lane, respectively, and thus the exit of the former connecting passage is located on the same side of the corresponding separator in the upper-layered road as the entrance of the latter connecting passage. Likewise, the connecting passages in the intervals 134 and 133 lead to and come from the fourth lane, respectively, and thus the exit of the former connecting passage is located on the same side of the corresponding separator in the upper-layered road as the entrance of the latter connecting passage. However, the connecting passages in the intervals 131 and 134 lead to the third lane and fourth lane, respectively, and thus the entrances of the two connecting passages are located on both sides of the corresponding separator in the lower-layered road.

Figure 28:
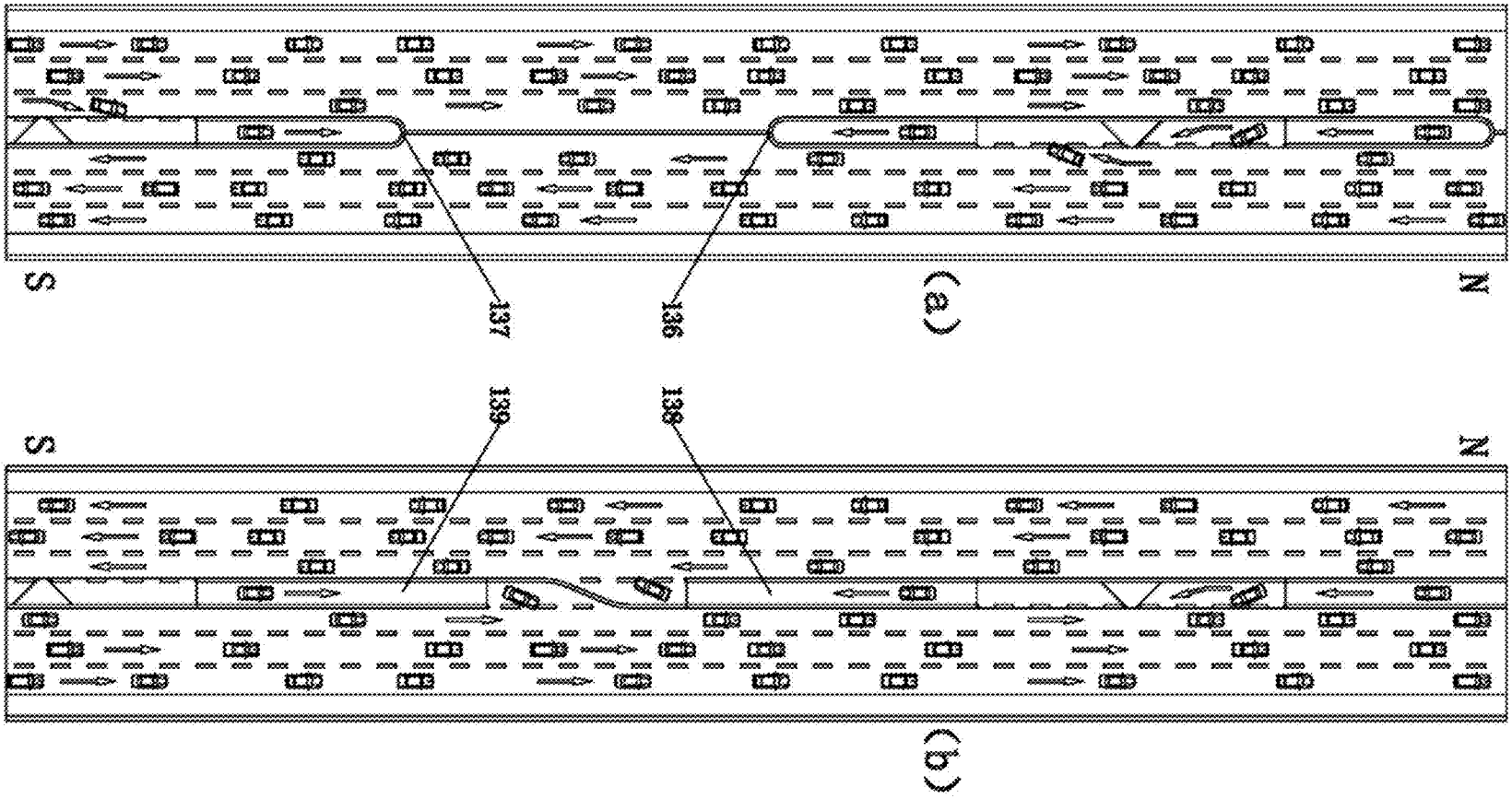

FIGS. 28(*a*) and (*b*) show the case of the elevated deck and the sub-road seen by removing the deck, respectively. The second road in this example is on an elevated surface and the first road is on the surface. As can be seen from the figure (b), the vehicle on the lower ground surface runs to the right, and the slope set positioned in the middle of the road continuously extends along the trend of the road. A set of ramp units 138 and 139 are arranged in a repeating cycle along the course of the road. (a) The figure is equivalent to the situation that a high-rise road board is additionally arranged in the figure (b), when a vehicle runs to the left, the oval road center entrances and exits 136 and 137 which are circularly arranged can be seen, and a separation railing is arranged between the two road center entrances and exits.

Figure 29:
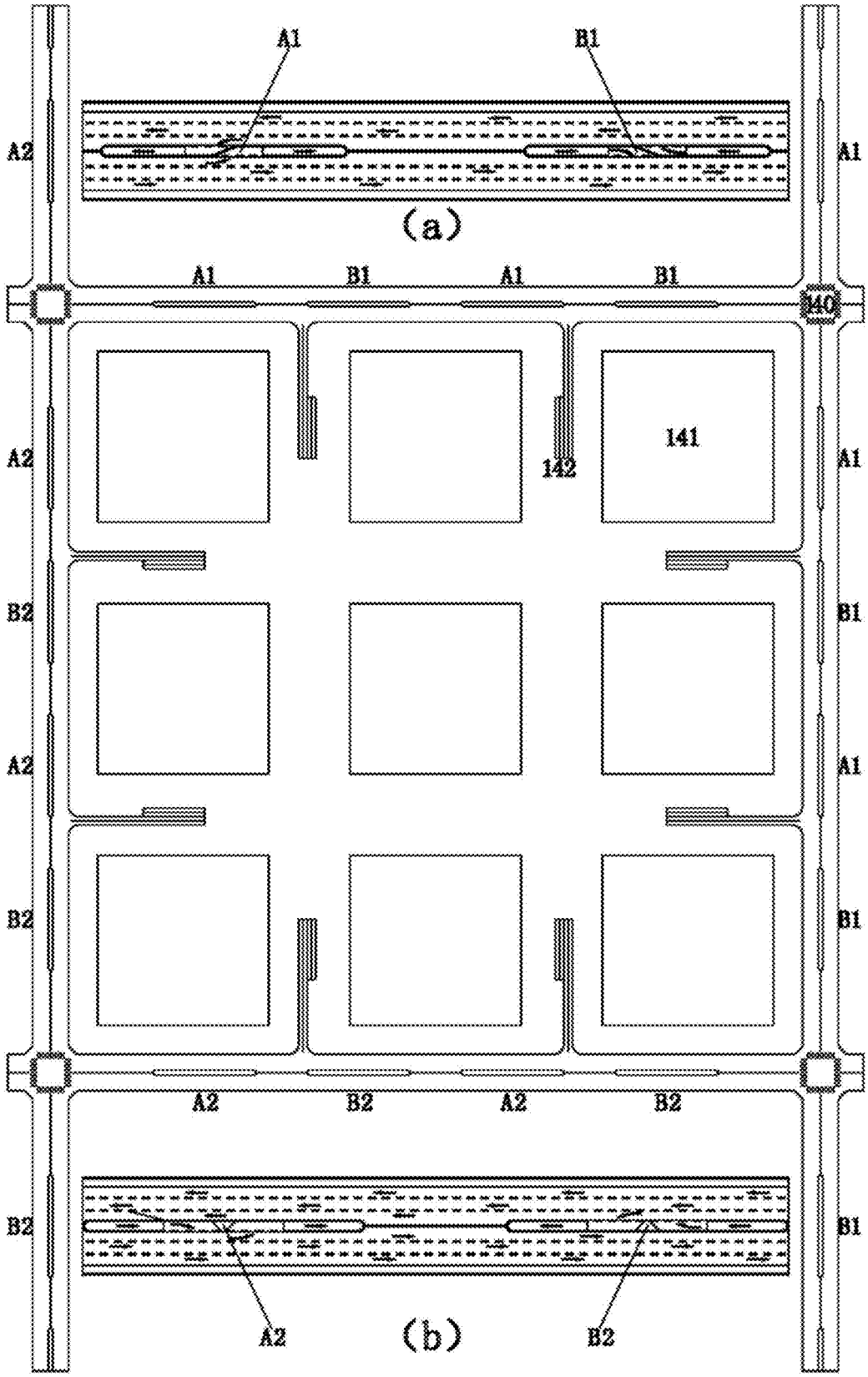
FIGS. 29 and 30 schematically show an embodiment of a double-layered road system according to the present invention.

FIG. 29 schematically shows a double-layered road system according to the invention. A central urban functional zone, such as a living community, is located in a grid of urban "chessboard roads", and four arterial roads around the community intersect at four intersections including an intersection 140. The arterial roads are three-dimensional type of a sunk second road. The community has nine buildings similar to a building 141, a branch road 142 leading to the arterial roads is located near the buildings, and eight similar branch roads are arranged. The branch road 142 in the figure uses a planar typed composite road module. Road middle entrances and exits are regularly distributed at the middle of the arterial road in the figure, and are arranged in a staggered arrangement of A type and B type. As mentioned above, the entrances and exits on the middle of the road are classified into two types: one is a high platform with openings on different sides, constitutional units of which are A1 and B1; the other is a high platform with openings on a same side, constitutional units of which are A2 and B2. Figures (a) and (b) show enlarged views of the road middle entrances and exits of the two types, respectively.

Figure 30:
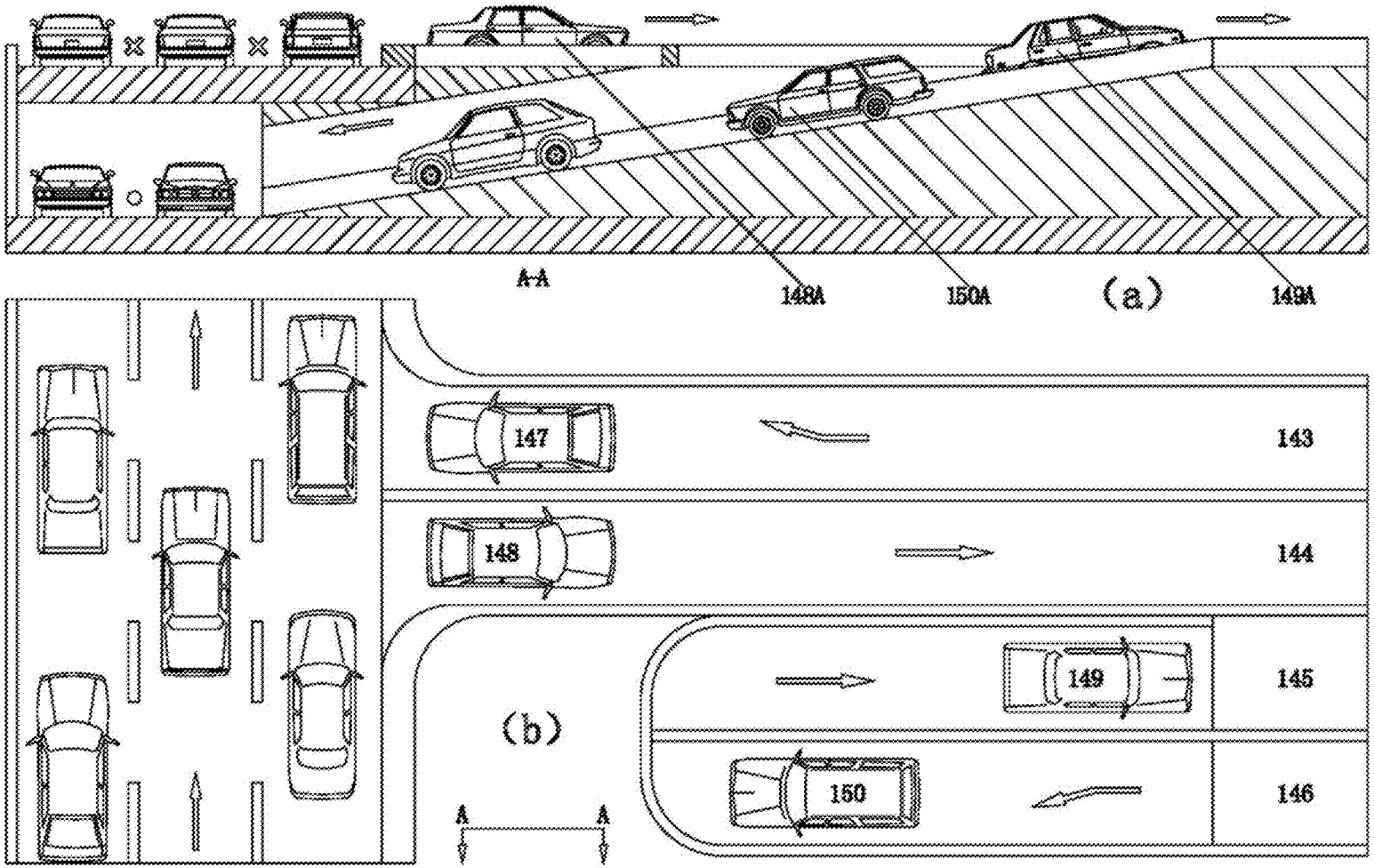

FIG. 30 shows an enlarged view of the intersection of the branch road 142 and the arterial road of FIG. 29, in which figure (a) shows a cut-away view taken along section A-A of figure (b), and vehicles 148A, 149A, 150A are further views of vehicles 148, 149, 150, respectively. The arterial road is in a three-dimensional mode, namely a double-layer composite road module. The branch road adopts a planar composite road module in which a first road comprises two passages 143 and 144 leading to an upper-layered road of the arterial road from the ground. A second road on its left side comprises two passages 145 and 146 leading to the lower-layered road of the arterial road. The planar composite road module and the three-dimensional composite road module are connected with each other in a way that their first roads are connected with each other, and their second roads are connected with each other. In figures (a) and (b), a right-turn vehicle 147 and a left-turn vehicle 150 running from the branch road to the arterial road directly turn on the ground and on the underground, respectively; a right-turn vehicle 148 and a left-turn vehicle 149 exiting the arterial road can also directly turn without detour.

The first road and the second road in the composite road module or unit are interdependent and matched with each other; if advanced computer control technology and a traffic command system are used for further optimizing and configuring supply-demand relationship of urban traffic, the predicament of urban traffic is effectively alleviated, and the comprehensive benefit of urban traffic is closer to an ideal target.

The technical features of the embodiments described above may be arbitrarily combined, and for the sake of brevity, all possible combinations of the technical features in the embodiments described above are not described, but should be considered as being within the scope of the present specification as long as there is no contradiction between the combinations of the technical features.

The above embodiments only express several embodiments of the present invention, and the description thereof is more specific and detailed, but not construed as limiting the scope of the present invention. It should be noted that, for a person skilled in the art, several variations and modifications can be made without departing from the inventive concept, which falls within the scope of the present invention. Therefore, the protection scopes of the present patent shall be defined by the appended claims.

What is claimed is:

1. A composite road module comprising a first road and a second road extending substantially in parallel, one of the first road and the second road being configured for vehicles to travel according to a left-hand traffic rule, the other of the first road and the second road being configured for vehicles to travel according to a right-hand traffic rule, the first road comprising a first lane and a second lane, the second road comprising a third lane and a fourth lane, wherein the first lane and the third lane are in communication with each other, and are provided for vehicles to travel in a first direction, and wherein the second lane and the fourth lane are in communication with each other, and are provided for vehicles to travel in a second direction opposite to the first direction.

2. A composite road unit comprising:

a composite road module according to claim 1; and one or two road junctions for a plurality of road directions, each road junction comprising a primary intersection and a secondary intersection, wherein the primary intersection comprises a primary central portion and a plurality of pairs of primary passages extending outwardly from the primary central portion in the plurality of road directions, respectively, each pair of primary passages comprising a primary ascending passage and a primary descending passage arranged side by side, wherein the secondary intersection is independent of the primary intersection, and comprises a secondary central portion and a plurality of pairs of secondary passages extending outwardly from the secondary central portion in the plurality of road directions, respectively, each pair of secondary passages comprising a secondary ascending passage and a secondary descending passage arranged side by side, wherein the primary ascending passage in each pair of primary passages communicates, via the primary central portion, with the primary descending passage of an adjacent pair of primary passages in one of a clockwise direction and a counter-clockwise direction, and the secondary ascending passage in each pair of secondary passages communicates, via the secondary central portion, with the secondary descending passage of an adjacent pair of secondary passages in the other of the clockwise direction and the counter-clockwise direction, and wherein a primary ascending passage and a primary descending passage of a pair of primary passages of the plurality of pairs of primary passages communicate with the first lane and the second lane of the composite road module, respectively, and a secondary ascending passage and a secondary descending passage of a corresponding pair of secondary passages of the plurality of pairs of secondary passages communicate with the third lane and the fourth lane of the composite road module, respectively.

3. The composite road module according to claim 1 wherein the second lane, the third lane, the fourth lane and the first lane are arranged sequentially side by side in a transverse direction.

4. The composite road module according to claim 3 further comprising a first, a second, a third and a fourth connecting passages, and the second road further comprises a first road segment and a second road segment, wherein the first road segment and the second road segment are sunk below the third lane and the fourth lane, or are elevated above the third lane and the fourth lane; and wherein the first connecting passage bypasses one port of the first road segment to communicate the first lane to the third lane, the second connecting passage bypasses one port of the second road segment to communicate the second lane to the fourth lane, the third connecting passage bypasses another port of the first road segment to communicate the third lane to the first lane, and the fourth connecting passage bypasses another port of the second road segment to communicate the fourth lane to the second lane.

5. The composite road module according to claim 1 wherein the first lane and the second lane are arranged side by side to form an upper-layered road, and the third lane and the fourth lane are arranged side by side to form a lower-layered road, and wherein the third lane and the fourth lane are located below the second lane and the first lane, respectively.

6. The composite road module according to claim 5 further comprising:

a first connecting passage that communicates the first lane to the third lane;

a second connecting passage that communicates the second lane to the fourth lane;

a third connecting passage that communicates the third lane to the first lane; and a fourth connecting passage that communicates the fourth lane to the second lane, wherein one end of each of the first, second, third and fourth connecting passages is located between the first lane and the second lane, and the other end is located between the third lane and the fourth lane, and wherein the upper-layered road comprises a first separator and a second separator between the first lane and the second lane, and the lower-layered road comprises a third separator between the third lane and the fourth lane.

7. A composite road module according to claim 6, wherein the upper-layered road further comprises a fourth separator between the first lane and the second lane, the fourth separator being located between the first separator and the second separator, and spaced apart from the first separator and the second separator so as to allow the first lane and the second lane to communicate with each other, and preferably, one or more of the first separator, the second separator, the third separator and the fourth separator are provided with no-entry zones or parking zones on both sides.

8. A composite road module according to claim 6, wherein the third, first, second and fourth connecting passages are arranged sequentially in a longitudinal direction, and wherein said one end of said third connecting passage and said one end of said first connecting passage are laterally on a same side of said first separator, said one end of said fourth connecting passage and said one end of said second connecting passage are laterally on the same side of said second separator, and said other end of said first connecting passage and said other end of said fourth connecting passage are laterally on both sides of said third separator.

9. The composite road module according to claim 8, wherein the first separator comprises a partition pillar at a side facing the first lane so as to longitudinally separate said one end of the third connecting passage from said one end of the first connecting passage, and preferably, the second separator comprises a partition pillar at a side facing the second lane so as to longitudinally separate said one end of the fourth connecting passage from said one end of the second connecting passage.

10. The composite road module according to claim 8 further comprising two sloping benches located between the upper-layered road and the lower-layered road, one of the two sloping benches being formed by the third connecting passage and the first connecting passage, and the other being formed by the fourth connecting passage and the second connecting passage.

11. A composite road module according to claim 10 wherein each sloping bench has a substantially trapezoidal longitudinal section, and preferably, each sloping bench comprises two U-turn passages for communicating the third lane with the fourth lane.

12. The composite road module according to claim 6 wherein the first, second, fourth and third connecting passages are arranged sequentially in a longitudinal direction, and wherein said one end of said first connecting passage and said one end of said second connecting passage are laterally located on both sides of said first separator, said one end of said third connecting passage and said one end of said fourth connecting passage are laterally located on both sides of said second separator, and said other end of said second connecting passage and said other end of said fourth connecting passage are laterally located on a same side of said third separator.

13. The composite road module according to claim 12 wherein the third separator comprises a partition pillar at a side facing the fourth lane so as to longitudinally separate said other end of the second connecting passage from said other end of the fourth connecting passage.

14. The composite road module according to claim 12, further comprising two sloping benches located between the upper-layered road and the lower-layered road, one of the two sloping benches being formed by the first connecting passage and the second connecting passage, and the other being formed by the fourth connecting passage and the third connecting passage.

15. A composite road module according to claim 14 wherein each sloping bench has a substantially trapezoidal longitudinal section, and preferably, each sloping bench comprises two U-turn passages for communicating the third lane with the fourth lane.

16. A composite road system comprising one or more composite road modules according to claim 1; and/or a composite road unit comprising:

one or two road junctions for a plurality of road directions, each road junction comprising a primary intersection and a secondary intersection, wherein the primary intersection comprises a primary central portion and a plurality of pairs of primary passages extending outwardly from the primary central portion in the plurality of road directions, respectively, each pair of primary passages comprising a primary ascending passage and a primary descending passage arranged side by side, wherein the secondary intersection is independent of the primary intersection, and comprises a secondary central portion and a plurality of pairs of secondary passages extending outwardly from the secondary central portion in the plurality of road directions, respectively, each pair of secondary passages comprising a secondary ascending passage and a secondary descending passage arranged side by side, wherein the primary ascending passage in each pair of primary passages communicates, via the primary central portion, with the primary descending passage of an adjacent pair of primary passages in one of a clockwise direction and a counter-clockwise direction, and the secondary ascending passage in each pair of secondary passages communicates, via the secondary central portion, with the secondary descending passage of an adjacent pair of secondary passages in the other of the clockwise direction and the counter-clockwise direction, and wherein a primary ascending passage and a primary descending passage of a pair of primary passages of the plurality of pairs of primary passages communicate with the first lane and the second lane of the composite road module, respectively, and a secondary ascending passage and a secondary descending passage of a corresponding pair of secondary passages of the plurality of pairs of secondary passages communicate with the third lane and the fourth lane of the composite road module, respectively.

* * * * *